US010146147B2

(12) United States Patent
Kayamori et al.

(10) Patent No.: US 10,146,147 B2
(45) Date of Patent: Dec. 4, 2018

(54) MAGENTA TONER FOR ELECTROSTATIC CHARGE IMAGE DEVELOPMENT

(71) Applicant: Konica Minolta, Inc., Tokyo (JP)

(72) Inventors: Takanari Kayamori, Kawasaki (JP); Masaharu Matsubara, Hachioji (JP); Naoya Tonegawa, Sagamihara (JP); Kouji Izawa, Tokyo (JP); Atsushi Iioka, Hino (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/934,472

(22) Filed: Mar. 23, 2018

(65) Prior Publication Data

US 2018/0284631 A1 Oct. 4, 2018

(51) Int. Cl.
*G03G 9/09* (2006.01)
*G03G 9/087* (2006.01)

(52) U.S. Cl.
CPC ..... *G03G 9/0924* (2013.01); *G03G 9/08755* (2013.01); *G03G 9/091* (2013.01); *G03G 9/092* (2013.01)

(58) Field of Classification Search
CPC ..... G03G 9/092; G03G 9/091; G03G 9/0924; G03G 9/08755
See application file for complete search history.

(56) References Cited

U.S. PATENT DOCUMENTS

2014/0322642 A1* 10/2014 Sacripante ..... G03G 9/08755 430/109.4
2017/0357168 A1* 12/2017 Kanno ..... G03G 9/091

FOREIGN PATENT DOCUMENTS

| | | | | |
|---|---|---|---|---|
| JP | 2002156795 | A | | 5/2002 |
| JP | 2003149869 | A | | 5/2003 |
| JP | 2003202706 | A | * | 7/2003 |
| JP | 2003207944 | A | * | 7/2003 |
| JP | 2007094270 | A | * | 4/2007 |
| JP | 2010102142 | A | * | 5/2010 |
| JP | 2013257415 | A | | 12/2013 |
| JP | 2014186194 | A | | 10/2014 |

OTHER PUBLICATIONS

English language machine translation of JP 2003-207944 (Jul. 2003).*
English language machine translation of JP 2007-094270 (Apr. 2007).*
English language machine translation of JP 2003-202706 (Jul. 2003).*
English language machine translation of JP 2010-1002142 (May 2010).*
English language machine translation of JP 2017-223931 (Dec. 2017).*

* cited by examiner

*Primary Examiner* — Christopher D Rodee
(74) *Attorney, Agent, or Firm* — Lucas & Mercanti, LLP

(57) ABSTRACT

To provide a magenta toner for electrostatic charge image development including a crystalline polyester resin and an amorphous resin as a binder resin, which is a means for improving low temperature fixability, scattering properties, GI value, saturation, and light fastness.
A magenta toner for electrostatic charge image development including an amorphous resin and a crystalline polyester resin as a binder resin, wherein predetermined quinacridone-based pigment, metal element-containing monoazo pigment, and naphthol AS-based pigment are included as a coloring agent, and the combined content of the quinacridone-based pigment and the metal element-containing monoazo pigment is 50-90% by mass of the total coloring agent.

10 Claims, No Drawings

MAGENTA TONER FOR ELECTROSTATIC CHARGE IMAGE DEVELOPMENT

CROSS-REFERENCE TO RELATED APPLICATION

Japanese Patent Application No. 2017-072129 filed on Mar. 31, 2017, including description, claims, drawings, and abstract the entire disclosure is incorporated herein by reference in its entirety.

BACKGROUND

1. Technical Field

The present invention relates to a magenta toner for electrostatic charge image development used in imaging in an electrophotographic mode.

2. Description of Related Arts

Conventionally, in an electrophotographic imaging method for forming a visible image by electrophotography, as a method for fixing a toner image formed by a toner for electrostatic charge image development (hereinafter, also simply referred to as "toner") on a transfer medium such as paper, a heat roller fixing method to pass a transfer medium on which a toner image is formed between a heating roller and a pressure roller to fix the toner image has been widely used. In order to secure fixability in this heat roller fixing method, that is, adhesiveness of the toner to the transfer medium such as paper, a high thermal capacity is required for the heating roller.

However, recently, in view of global environmental warming prevention measures, energy saving is more requested also on an electrophotographic imaging device, and thus, particularly in the electrophotographic imaging device adopting a heat roller fixation method, a technique to reduce calories required for fixing a toner image, that is, low temperature fixation of a toner is being reviewed a lot, and representatively, a technique using crystalline materials may be mentioned.

For example, a technique asserting a toner containing a crystalline polyester resin and an amorphous resin wherein the crystalline polyester resin forming toner base particles is contained as a filamentary crystal structure, and the domain diameter thereof is adjusted to further promote sharp melting, thereby achieving sufficient low temperature fixability, has been suggested (see JP 2013-257415 A). In addition, a technique asserting that a crystalline polyester resin is finely dispersed to an average diameter of 300 nm or less in a core portion of three-layered toner particles, thereby being present as a domain phase inside of the core, and proceeding to be compatible in thermal fixation, and also as a result of having low crystallinity, a crystallinity deviation is reduced, and the obtained image has high gloss uniformity has been suggested (see JP 2014-186194 A).

Meanwhile, a toner using a quinacridone-based pigment and a monoazo-based pigment not containing a metal element such as naphthol AS-based pigment, as a pigment in a magenta toner, and having an average circularity of 0.950 or more, wherein it has excellent color reproducibility, gradation, light fastness and charging characteristics (see JP 2002-156795 A), or obtaining a magenta toner having good pigment dispersibility, chargeability and transferability by including as a main component, a monoazo pigment not containing a metal element as a coloring agent, and adding a β-naphthol derivative, aromatic amine, a quinacridone-based pigment and the like (see JP 2003-149869 A) has been reported.

SUMMARY

However, according to the present inventors' review, it has been confirmed that it is still difficult to obtain performance satisfying all of image quality, light fastness, saturation, toner scattering properties and fixability with the magenta toner suggested in the related art. In particular, it has been found that a toner having a crystalline polyester resin has insufficient low temperature fixability, a GI value and saturation, with combined use of two kinds of pigments, a quinacridone-based pigment and a naphthol AS-based pigment not containing a metal element.

The present invention was achieved considering the above-described circumstances, and the object of the present invention is to provide a means to improve low temperature fixability, scattering properties, a GI value, saturation, and light fastness, in a magenta toner for electrostatic charge image development having a crystalline polyester resin and an amorphous resin as a binder resin.

The present inventors conducted intensive studies in view of the above problems. As a result, it was found that the problems may be solved by a magenta toner for electrostatic charge image development including an amorphous resin and a crystalline polyester resin as a binder resin, wherein predetermined quinacridone-based pigment, metal element-containing monoazo pigment, and naphthol AS-based pigment are used in combination as a coloring agent, and a combined content of the quinacridone-based pigment and the metal element-containing monoazo pigment is 50-90% by mass of the total coloring agent, thereby completing the present invention.

That is, according to an embodiment of the present invention, a magenta toner for electrostatic charge image development including an amorphous resin and a crystalline polyester resin as a binder resin is provided, wherein a quinacridone-based pigment represented by the following General Formula (1), a metal element-containing monoazo pigment represented by the following General Formula (2) or (2'), and a naphthol AS-based pigment represented by the following General Formula (3) are included as a coloring agent, and a combined content of the quinacridone-based pigment and the metal element-containing monoazo pigment is 50-90% by mass of the total coloring agent:

[Chemical Formula 1]

(1)

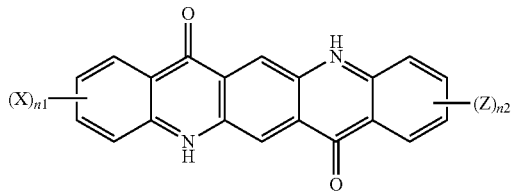

wherein X and Z are independently of each other a halogen atom, or an optionally substituted alkyl group or alkoxy group; and n1 and n2 are an integer of 0-4, respectively;

[Chemical Formula 2]

(2)

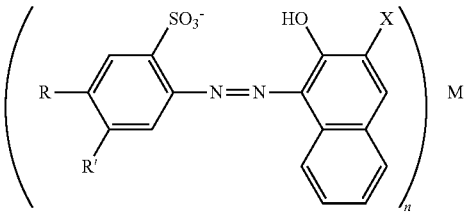

(2')

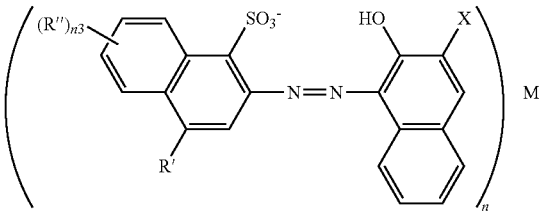

wherein R and R' denote a hydrogen atom, a halogen atom, or an optionally substituted alkyl group or alkoxy group; R" denotes a halogen atom, or an optionally substituted alkyl group or alkoxy group; n3 is an integer of 0-4; X is a hydrogen atom or a carboxylic acid anion; M is a monovalent or divalent metal ion; and n is a number determined by a valence number of X and M so that the metal element-containing monoazo pigment is electrically neutral;

[Chemical Formula 3]

(3)

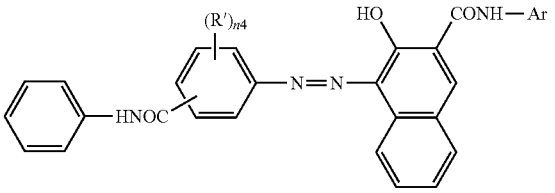

wherein R' is an optionally substituted alkyl group or alkoxy group; n4 is an integer of 0-4; and Ar is a hydrogen atom, an optionally substituted aryl group, or the following:

[Chemical Formula 4]

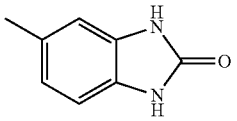

DETAILED DESCRIPTION OF EMBODIMENTS

Hereinafter, one or more embodiments of the present invention will be described in detail. However, the scope of the invention is not limited to the disclosed embodiments.

<Toner>

The magenta toner for electrostatic charge image development according to an embodiment of the present invention includes an amorphous resin and a crystalline polyester resin as a binder resin. Herein, it is characterized in that predetermined quinacridone-based pigment, metal element-containing monoazo pigment, and naphthol AS-based pigment are included as a coloring agent, and a combined content of the quinacridone-based pigment and the metal element-containing monoazo pigment is 50-90% by mass of the total coloring agent. The toner having the constitution according to the present invention represents a balanced combination of excellent low temperature fixability, scattering properties, a GI value, saturation, and light fastness. That is, according to the present invention, the magenta toner for electrostatic charge image development including a crystalline polyester resin and an amorphous resin as a binder resin has improved low temperature fixability, scattering properties, a GI value, saturation, and light fastness. The mechanism expressing these effects is not completely clear, but presumed as follows:

That is, the metal element-containing monoazo pigment is present as a metal salt, and the metal ion thereof is positively charged. Meanwhile, since the crystalline polyester resin is negatively charged, it is presumed that by their interaction, the uptake and dispersibility properties of the coloring agent in the toner are improved, thereby improving the low temperature fixability of the toner. In addition, it is considered that the dispersibility of the coloring agent including the metal element-containing monoazo pigment is also improved, thereby improving the GI value and saturation, as compared with the case using only two kinds of pigments, a quinacridone-based pigment and a naphthol AS-based pigment not containing a metal element in combination. Further, a mixing ratio of these pigments is controlled to a predetermined range, thereby suppressing re-aggregation of a quinacridone-based pigment which may occur in the toner base particles, by the presence of naphthol AS-based pigment and metal element-containing monoazo pigment, which leads to obtaining more balanced performance.

Hereinafter, the constituents of the toner according to the present invention is described in detail. The "toner base particle" referred in the present specification is formed by including at least a binder resin and a coloring agent, but not including an external additive.

(Toner Base Particles)

The toner base particles of the toner according to the present invention contains an amorphous resin and a crystalline polyester resin as a binder resin, and has predetermined quinacridone-based pigment, metal element-containing monoazo pigment, naphthol AS-based pigment as a coloring agent, wherein the combined content of the quinacridone-based pigment and the metal element-containing monoazo pigment is 50-90% by mass of the total coloring agent. In addition, the toner base particles may contain other toner constituents such as a release agent, magnetic powder and a charge control agent as required. In addition, in the toner according to the present invention, it is preferred that the toner base particles are obtained by a wet preparation method to prepare the particles in a water-based medium (e.g., an emulsion aggregation method, etc.).

<Binder Resin (Amorphous Resin and Crystalline Polyester Resin)>

In the toner according to the present invention, the toner base particles contain an amorphous resin and a crystalline polyester resin as a binder resin.

Amorphous Resin

An amorphous resin refers to a resin representing amorphousness having a glass transition point (Tg), but having no melting point, that is, no clear endothermic peak at elevated temperature, in an endothermic curve obtained by DSC.

The amorphous resin is used as a binder resin together with the crystalline polyester resin, and forms the toner base particles. By including the amorphous resin, appropriate fixation strength and image gloss are obtained, and simultaneously good chargeability is obtained even under environments that fluctuate in temperature and humidity. In the toner according to the present invention, the amorphous resin may be one kind, or a mixture of various kinds. In addition, as an example of the amorphous resin, an amorphous vinyl resin, an amorphous polyester resin, a hybrid amorphous polyester resin, or the like may be preferably mentioned. These amorphous resins may be obtained by a known synthesis method, or commercially available. In addition, in the case that the toner base particles have a core shell structure, in view of dispersion state controllability or charging characteristics in the toner particles containing the crystalline polyester resin, it is preferred that the amorphous vinyl resin and the crystalline polyester resin form a core portion, and it is also preferred that the amorphous polyester resin forms a shell layer.

(Amorphous Vinyl Resin)

As described above, it is preferred that the amorphous resin includes the amorphous vinyl resin. By including the amorphous vinyl resin in the amorphous resin, a toner having excellent plasticity during thermal fixation may be provided. Herein, the term "vinyl resin" is a resin obtained by polymerization using at least a vinyl monomer. As the amorphous vinyl resin, specifically an acrylic resin, a styrene acrylic copolymer resin (styrene acrylic resin), and the like may be listed. Among these, as the amorphous vinyl resin, a styrene acrylic copolymer resin (styrene acrylic resin) formed using a styrene monomer and a (meth)acrylic acid ester monomer is preferred.

As a vinyl monomer forming the amorphous vinyl resin, one or two or more selected from the following may be used:

(1) Styrene Monomer styrene, o-methylstyrene, m-methylstyrene, p-methylstyrene, a-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene, and the derivatives thereof, etc.

(2) (Meth)Acrylic Acid Ester Monomer methyl (meth)acrylate, ethyl (meth)acrylate, n-butyl (meth)acrylate, isopropyl (meth)acrylate, isobutyl (meth) acrylate, t-butyl (meth)acrylate, n-octyl (meth)acrylate, 2-ethylhexyl (meth)acrylate, stearyl (meth)acrylate, lauryl (meth)acrylate, phenyl (meth)acrylate, diethylaminoethyl (meth)acrylate, dimethylaminoethyl (meth)acrylate, and the derivatives thereof, etc.

(3) Vinyl Esters vinyl propionate, vinyl acetate, vinyl benzoate, etc.

(4) Vinyl Ethers vinyl methyl ether, vinyl ethyl ether, etc.

(5) Vinyl Ketones vinyl methyl ketone, vinyl ethyl ketone, vinyl hexyl ketone, etc.

(6) N-Vinyl Compounds

N-vinylcarbazole, N-vinylindole, N-vinylpyrrolidone, etc.

(7) Others vinyl compounds such as vinyl naphthalene and vinyl pyridine, acrylic acid or methacrylic acid derivatives such as acrylonitrile, methacrylonitrile and acrylamide, etc.

In addition, as the vinyl monomer, it is preferred to use, for example, a monomer having an ionic dissociation group such as a carboxyl group, a sulfonic acid group and a phosphate group. Specifically, the followings may be mentioned:

As a monomer having a carboxyl group, acrylic acid, methacrylic acid, maleic acid, itaconic acid, cinnamic acid, fumaric acid, maleic acid monoalkyl ester, itaconic acid monoalkyl ester, and the like may be listed. In addition, as a monomer having a sulfonic acid group, styrene sulfonic acid, allyl sulfosuccinic acid, 2-acrylamide-2-methylpropane sulfonic acid, and the like may be listed. In addition, as a monomer having a phosphate group, acid phosphooxyethyl methacrylate and the like may be listed.

In addition, the amorphous vinyl resin may have a cross-linked structure, by using polyfunctional vinyls as a vinyl monomer. As the polyfunctional vinyls, divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, and the like may be listed.

(Amorphous Polyester Resin)

The toner of the present embodiment may include the amorphous polyester resin as the amorphous resin. In particular, in view of obtaining appropriate compatibility, and shape controllability of toner particles or image intensity after fixation, it is preferred to use the amorphous vinyl resin and the amorphous polyester resin in combination.

The amorphous polyester resin refers to a polyester resin obtained by a polycondensation reaction of a divalent or higher carboxylic acid (polyvalent carboxylic acid component) with a divalent or higher alcohol (polyhydric alcohol component), wherein a clear endothermic peak is not recognized in DSC.

As the polyvalent carboxylic acid component, for example, dicarboxylic acids such as oxalic acid, succinic acid, maleic acid, adipic acid, β-methyladipic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1, 2-dicarboxylic acid, malic acid, citric acid, hexahydroterephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxy phenyl acetic acid, p-phenylene diacetic acid, m-phenylene diglycolic acid, p-phenylene diglycolic acid, o-phenylene diglycolic acid, diphenyl acetic acid, diphenyl-p,p'-dicarboxylic acid, naphthalene-1,4-dicarboxylic acid, naphthalene-1,5-dicarboxylic acid, naphthalene-2,6-dicarboxylic acid, anthracene dicarboxylic acid and dodecenyl succinic acid; trimellitic acid, pyromellitic acid, naphthalene tricarboxylic acid, naphthalene tetracarboxylic acid, pyrene tricarboxylic acid, pyrene tetracarboxylic acid, and the like may be listed. These polyvalent carboxylic acids may be used alone or in combination of two or more.

Among them, in view of easily obtaining the effect of the present invention, it is preferred to use an aliphatic unsaturated dicarboxylic acid such as fumaric acid, maleic acid and mesaconic acid, an aromatic dicarboxylic acid such as isophthalic acid or terephthalic acid, succinic acid, trimellitic acid.

In addition, as the polyhydric alcohol component, for example, dihydric alcohols such as ethylene glycol, propylene glycol, butanediol, diethylene glycol, hexanediol, cyclohexanediol, octanediol, decanediol, dodecanediol, an ethylene oxide adduct of bisphenol A and a propylene oxide adduct of bisphenol A; trihydric or higher polyols such as glycerin, pentaerythritol, hexamethylolmelamine, hexaethylolmelamine, tetramethylol benzoguanamine and tetraethylol benzoguanamine, and the like may be listed. These polyhydric alcohol components may be used alone or in combination of two or more.

Among these, in view of easily obtaining the effects of the present invention, the dihydric alcohols such as the ethylene oxide adduct of bisphenol A and the propylene oxide adduct of bisphenol A are preferred.

The usage ratio of the polyvalent carboxylic acid component and the polyhydric alcohol component is preferably 1.5/1-1/1.5 of [OH]/[COOH] which is the equivalence ratio of the hydroxyl group, [OH] of the polyhydric alcohol component and the carboxyl group, [COOH] of the polyvalent carboxylic acid component, and more preferably 1.2/1-1/1.2. Within the range of the usage ratio of the polyhydric alcohol component and the polyvalent carboxylic acid component, it is easier to control the acid value and molecular weight of the amorphous polyester resin.

The preparation method of the amorphous polyester resin is not particularly limited, and the amorphous polyester resin may be prepared by polycondensing (esterifying) the polyvalent carboxylic acid component and the polyhydric alcohol component, using a known esterification catalyst.

Since the catalyst which may be used in the preparation of the amorphous polyester resin is similar to the catalyst described in the following crystalline polyester resin section, the description thereof is omitted here.

The polymerization temperature is not particularly limited, but 150-250° C. is preferred. In addition, the polymerization time is not particularly limited, but 0.5-10 hours are preferred. During the polymerization, the inside of the reaction system may be pressure-reduced if required.

The glass transition temperature (Tg) of the amorphous resin is preferably 25-60° C., more preferably 35-55° C. Within the range of the glass transition temperature of the amorphous resin, sufficient low temperature fixability and thermal resistant storability which are compatible with each other may be obtained. In addition, the glass transition temperature (Tg) of the amorphous resin is a value measured using "Diamond DSC" (manufactured by PerkinElmer). The measurement procedure is as follows: 3.0 mg of a measurement sample (amorphous resin) was enclosed in an aluminum pan, and set in a holder. As the reference, an empty aluminum pan was used. The measurement conditions were measurement temperature of 0-200° C., a heating rate of 10° C./min, and a cooling rate of 10° C./min. The temperature was controlled by heat-cool-heat, and the interpretation was based on the data from the $2^{nd}$ heat. An extension line of a baseline before a first endothermic peak rises, and a tangent line representing a maximum slope between the point at which the first peak begins to rise and the peak point were drawn, and the intersection therefrom was set as a glass transition temperature.

Further, the molecular weight measured by gel permeation chromatography (GPC) of the amorphous resin is preferably 10,000-200,000 as a weight average molecular weight (Mw). In the present invention, the molecular weight of the amorphous resin by GPC is a value measured as follows. That is, an apparatus of "HLC-8120 GPC" (manufactured by TOSOH CORPORATION) and a column of "TSKguardcolumn+TSKgelSuperHZ-M3 series" (manufactured by TOSOH CORPORATION) are used, tetrahydrofuran (THF) as a carrier solvent is flowed at a flow speed of 0.2 ml/min while maintaining the column temperature at 40° C., and a measurement sample (amorphous resin) is dissolved in tetrahydrofuran to have a concentration of 1 mg/ml under the dissolution condition of carrying out the treatment at room temperature for 5 minutes using an ultrasonic dispersing machine. Then, treatment with a membrane filter having a pore size of 0.2 μm is performed to obtain a sample solution, 10 μl of this sample solution is injected into the apparatus together with the carrier solvent, detection is performed using a refractive index detector (RI detector), and a molecular weight distribution of the measurement sample is calculated using a calibration curve measured using monodisperse polystyrene standard particles. Ten points are used as polystyrene for measuring the calibration curve.

Crystalline Polyester Resin

The toner of the present invention includes a crystalline polyester resin as the binder resin. Herein, the "crystalline polyester resin" refers to a resin having a clear endothermic peak, not a step-wise endothermic change in differential scanning calorimetry (DSC), among known polyester resins obtained by a polycondensation reaction of a divalent or higher carboxylic acid (polyvalent carboxylic acid) and a dihydric or higher alcohol (polyhydric alcohol). The clear endothermic peak specifically refers to a peak having a half width of 15° C. or less, when performing measurement at a heating rate of 10° C./min, in differential scanning calorimetry (DSC).

The polyvalent carboxylic acid is a compound containing two or more carboxyl groups in one molecule. Specifically, for example, saturated aliphatic dicarboxylic acids such as oxalic acid, malonic acid, succinic acid, adipic acid, sebacic acid, azelaic acid, n-dodecylsuccinic acid, nonanedicarboxylic acid, decanedicarboxylic acid, undecanedicarboxylic acid, dodecanedicarboxylic acid and tetradecanedicarboxylic acid; cycloaliphatic dicarboxylic acids such as cyclohexanedicarboxylic acid; aromatic dicarboxylic acids such as phthalic acid, isophthalic acid and terephthalic acid; trivalent or higher polyvalent carboxylic acids such as trimellitic acid and pyromellitic acid; and anhydrides, or alkyl esters having carbon atoms of 1-3 of these carboxylic acid compounds, may be listed. These may be used alone or in combination of two or more.

The polyhydric alcohol refers to a compound containing two or more hydroxyl groups in one molecule. Specifically, for example, aliphatic diols such as 1,2-propanediol, 1,3-propanediol, 1,4-butanediol, 1,5-pentanediol, 1,6-hexanediol, 1,7-heptanediol, 1,8-octanediol, 1,9-nonanediol, dodecanediol, neopentyl glycol, 1,4-butenediol; trihydric or higher polyhydric alcohols such as glycerin, pentaerythritol, trimethylolpropane and sorbitol, and the like may be listed. These may be used alone or in combination of two or more.

The crystalline polyester resin (including a hybrid crystalline polyester resin as described below) has a melting point (Tm) of preferably 55-90° C., more preferably 70-85° C. Within the range of the melting point of the crystalline polyester resin, sufficient low temperature fixability and excellent hot-offset resistance are obtained. In addition, the melting point of the crystalline polyester resin may be controlled by the resin composition.

In the present invention, the melting point of the crystalline polyester resin is measured as follows. That is, the measurement is performed by the measurement conditions (heating/cooling conditions) going through a first heating process of raising the temperature from 0° C. to 200° C. at a heating rate of 10° C./min, a cooling process of cooling the temperature from 200° C. to 0° C. at a cooling rate of 10° C./min, and a second heating process of raising the temperature from 0° C. to 200° C. at a heating rate of 10° C./min in order, using a differential scanning calorimeter, "Diamond DSC" (manufactured by PerkinElmer), and based on the DSC curve obtained from this measurement, an endothermic peak top temperature derived from the crystalline polyester resin in the first heating process is set as the melting temperature (Tm). The measurement order is enclosing 3.0 mg of a measurement sample (crystalline polyester resin) in an aluminum pan, and setting it in a Diamond DSC sample holder. As the reference, an empty aluminum pan is used.

In addition, the molecular weight of the crystalline polyester resin measured by gel permeation chromatography (GPC) is preferably 5,000-50,000 as a weight average molecular weight (Mw), and 1,500-25,000 as a number average molecular weight (Mn). The molecular weight of the crystalline polyester resin measured by GPC is measured similarly to the amorphous resin except for using the crystalline polyester resin as a measurement sample.

In addition, in the present invention, the acid value of the crystalline polyester resin is preferably 15-30 mgKOH/g. Within this range, the affinity of the amorphous resin and crystalline polyester resin with the coloring agent is secured, and a toner having fixability, chargeability, and excellent image quality may be obtained.

Besides, the acid value may be controlled by the reaction conditions such as the kind or compositional ratio of the diol component or dicarboxylic acid component, the catalyst amount used in the polycondensation reaction or adjustment of a polymerization initiator, and reaction temperature or time. In addition, the longer the reaction time is, the higher the molecular weight tends to be, and accordingly, the acid value tends to be lowered. The acid value is the mass of potassium hydroxide (KOH) in mg needed to neutralize an acid contained in 1 g of a resin, and measured according to JIS K0070-1966. Specifically, it may be calculated by the following procedures.

(1) Preparation of Reagents 1.0 g of phenolphthalein is dissolved in 90 ml of ethyl alcohol (95% by volume), and ion-exchange water is added thereto to be 100 ml, thereby preparing a "phenolphthalein solution".

7 g of JIS special grade potassium hydroxide is dissolved in 5 ml of ion-exchange water, and ethyl alcohol (95% by volume) was added to be 1 L. This solution is added to an alkali-resistant container so that it does not come into contact with carbon dioxide gas, allowed to stand for 3 days, and filtered, thereby preparing a "potassium hydroxide solution". Standardization is according to the description of JIS K0070-1966.

(2) Operation (a) Main Test 2.0 g of a pulverized resin sample is precisely weighed in a 200 ml Erlenmeyer flask, 100 ml of a mixed solution of toluene/ethanol (2:1) is added, and dissolved for 5 hours. Next, a few drops of the phenolphthalein solution as an indicator are added, and titration is performed using the potassium hydroxide solution. In addition, the end point of the titration is set when the light red color of the indicator lasts for about 30 seconds.

(b) Blank Test

The sample is not used. That is, the operation is carried out similarly to the above operation, except for using only the mixed solution of toluene/ethanol (2:1).

(3) Calculation of Acid Value

The acid value is calculated by substituting the obtained result into the following Equation 1:

$$A=[(C-B)\times f\times 5.6]/S \quad \text{Equation 1}$$

wherein

A: acid umber (mgKOH/g),

B: added amount (ml) of the potassium hydroxide solution in the blank test,

C: added amount (ml) of the potassium hydroxide solution in the main test, f: a factor of 0.1 mol/L of the potassium hydroxide ethanol solution, and S: sample (g).

Though the content of the crystalline polyester resin in the binder resin is not particularly limited, when the toner base particles include a release agent, the content is preferably 5-30% by mass, more preferably 5-20% by mass, based on total 100% by mass of the binder resin and the release agent. In addition, when the crystalline polyester resin includes a hybrid crystalline polyester resin, the range is also preferred. Within the range, the crystalline polyester resin is not exposed to the surface of the toner particles to be formed, or even in the case of being exposed, the exposed amount is extremely small, and at the same time, a crystalline resin in an amount to attempt low temperature fixability may be introduced to the toner base particles. Further, the balance between the positive charge of the metal element-containing monoazo pigment and the negative charge of the crystalline polyester resin is improved, thereby obtaining more significant effects of the present invention.

It is preferred that the crystalline polyester resin includes the crystalline polyester resin formed by chemical bonding a vinyl polymerization segment and a crystalline polyester polymerization segment (hereinafter, the crystalline polyester resin having a plurality of segments is also simply referred to as "hybrid crystalline polyester resin", and the crystalline polyester resin having no plurality of segments is also simply referred to as "non-hybrid crystalline polyester resin"). Herein, it is preferred that the crystalline polyester resin is a crystalline resin where the vinyl polymerization segment and the crystalline polyester polymerization segment are bonded by a both-reactive monomer. In addition, the crystalline polyester polymerization segment is formed by the crystalline polyester resin. The crystalline polyester resin includes the hybrid crystalline polyester resin, thereby increasing crystallinity. This is considered to be due to the fact that the vinyl polymerization segment introduced to the hybrid crystalline polyester resin has high affinity with the amorphous resin, and thus, it is easier for the hybrid crystalline polyester resin to be compatible (to be fixed) with the amorphous resin, and as a result, it is easier to arrange the molecular chains of the crystalline polyester resin. In addition, by using the hybrid crystalline polyester resin, it is easier to be compatible with the amorphous resin such as a styrene acrylic resin, thereby having a better uptake to the amorphous resin, and more uniformly dispersing the crystalline polyester resin in the toner base particles, and thus, improving the low temperature fixability. In addition, as the dispersibility of the coloring agent in the toner base particles is improved, low temperature fixability, scattering properties, and image quality may be improved.

Vinyl Polymerization Segment

The vinyl polymerization segment forming the hybrid crystalline polyester resin includes a resin obtained by polymerizing vinyl monomers. Herein, since as the vinyl monomer, those described above as a monomer forming the vinyl resin may be similarly used, detailed description thereof is omitted. In addition, though the content of the vinyl polymerization segment in the hybrid crystalline polyester resin (hybridization ratio) is not particularly limited, in the case that the hybrid crystalline polyester resin is used in combination with the non-hybrid crystalline polyester resin or the amorphous polyester resin, the hybridization ratio of the hybrid crystalline polyester resin is preferably in a range of 5-30% by mass, more preferably in a range of 5-20% by mass, and particularly preferably in a range of 5-10% by mass. Further, in the case that the hybrid crystalline polyester resin is not used in combination with the non-hybrid crystalline polyester resin or the amorphous polyester resin, the hybridization ratio of the hybrid crystalline resin is preferably 40% by mass or more, more preferably 40-60% by mass, and particularly preferably 45-50% by mass.

Crystalline Polyester Polymerization Segment

The crystalline polyester polymerization segment forming the hybrid crystalline polyester resin includes the crystalline polyester resin prepared by carrying out a polycondensation reaction of the polyvalent carboxylic acid and the polyhydric alcohol in the presence of a catalyst. Herein, since the specific kinds of the polyvalent carboxylic acid and the polyhydric alcohol are as described above, the detailed description thereof is omitted here.

Both Reactive Monomer

The "both reactive monomer" which is a monomer binding the crystalline polyester polymerization segment and the vinyl polymerization segment, has both of a group forming the crystalline polyester polymerization segment, selected from a hydroxyl group, a carboxyl group, an epoxy group, a primary amino group and a secondary amino group, and an ethylenic unsaturated group forming the vinyl polymerization segment, in one molecule. Preferably, the both reactive monomer is a monomer having either of a hydroxyl group and a carboxyl group, and an ethylenic unsaturated group. More preferably, it is a monomer having a carboxyl group and an ethylenic unsaturated group. That is, it is preferably vinyl carboxylic acid.

The specific example of the both reactive monomer may include, for example, acrylic acid, methacrylic acid, fumaric acid, maleic acid, and the like, and also, the esters of hydroxyalkyl (having 1-3 carbon atoms) thereof, but acrylic acid, methacrylic acid or fumaric acid is preferred, in view of reactivity. By this both reactive monomer, the crystalline polyester polymerization segment and the vinyl polymerization segment are bonded.

The used amount of the both reactive monomer is preferably 1-10 parts by mass, more preferably 4-8 parts by mass, based on total 100 parts by mass of the vinyl monomer forming the vinyl polymerization segment, in view of improving the low temperature fixability, high temperature offset resistance and durability of the toner.

Preparation Method of Hybrid Crystalline Polyester Resin

As the preparation method of the hybrid crystalline polyester resin, a conventional common scheme may be used. As representative methods, the following three methods may be listed:

(1) previously polymerizing the crystalline polyester polymerization segment, reacting the crystalline polyester polymerization segment with the both reactive monomer, and further reacting the aromatic vinyl monomer and the (meth)acrylic acid ester monomer for forming the vinyl polymerization segment, thereby forming the hybrid crystalline polyester resin, (2) previously polymerizing the vinyl polymerization segment, reacting the vinyl polymerization segment with the both reactive monomer, and further, reacting the polyvalent carboxylic acid and the polyhydric alcohol for forming the crystalline polyester polymerization segment, thereby forming the crystalline polyester polymerization segment, and (3) previously polymerizing the crystalline polyester polymerization segment and the vinyl polymerization segment, and reacting them with the both reactive monomer, thereby binding the two.

In the present invention, the above preparation methods may be all used, but the method of (2) is preferred. Specifically, it is preferred to mix the polyvalent carboxylic acid and the polyhydric alcohol for forming the polyester polymerization segment, and the vinyl monomer and the both reactive monomer for forming a vinyl polymerization segment, add a polymerization initiator, perform addition polymerization of the vinyl monomer and the both reactive monomer to form the vinyl polymerization segment, and then add an esterification catalyst, and perform a polycondensation reaction.

Herein, as the catalyst for synthesizing the crystalline polyester polymerization segment (or crystalline polyester resin), conventionally known various catalysts may be used. In addition, as the esterification catalyst, a tin compound such as di-butyl tin oxide and 2-ethyl tin hexanoate(II), a titanium compound such as titanium diisopropylate bistriethanolaminate, tetrabutoxytitanium (titanium tetrabutoxide, $Ti(O\text{-}n\text{-}Bu)_4$), tetraoctoxytitanium and tetrastearoxytitanium, and the like may be listed, and as the esterification cocatalyst, gallic acid and the like may be listed.

Existence Form of Crystalline Polyester Resin

In the magenta toner of the present invention, it is preferred that the binder resin has a domain matrix structure formed by dispersing a domain phase including the crystalline polyester resin in a matrix phase including the amorphous resin. Particularly, it is preferred that the binder resin has a domain matrix structure in which the amorphous resin containing at least styrene acrylic resin is the matrix, and the crystalline polyester resin is the domain.

It is preferred that the binder resin has the domain matrix structure, since this leads the domain to be a discontinuous part, thereby causing relaxation of local stress, and a negatively charged crystalline resin is discontinuously present, so that a positively charged metal element-containing monoazo pigment is also attracted to improve dispersibility. Further, when the domain phase is the crystalline polyester resin, and the matrix phase is the amorphous resin having the styrene acrylic resin, by uptake of the crystalline polyester resin into the inside by the amorphous resin, the crystalline polyester resin does not exist, or even in the case that it exists, the amount is extremely small, on the surface of the toner base particles obtained, and as a result, long-term stability of charging performance may be obtained. In addition, since the crystalline polyester resin may be highly dispersed in a crystal state, the fixability and thermal resistance of the obtained toner may be improved.

Herein, the "domain matrix structure" refers to a structure in which a domain phase having a closed interface (boundary between phases) exists in a continuous matrix phase. The toner base particles according to the present invention represent a state in which the crystalline resin is incompatibly introduced into the amorphous resin. In addition, this structure may be confirmed by observing the section of the toner base particle stained by ruthenium by a conventional method using a transmission electron microscope.

<Coloring Agent>

The magenta toner of the present invention includes predetermined quinacridone-based pigment, metal element-containing monoazo pigment, and naphthol AS-based pigment as the coloring agent.

In addition, in the toner according to the present invention, in the case that the binder resin has a domain matrix structure, the coloring agent may be contained in either of the matrix phase (amorphous resin phase) and the domain phase (crystalline polyester resin phase), but in view of dispersibility of the coloring agent, preferably contained particularly in the matrix phase (amorphous resin phase).

[Quinacridone-based Pigment]

The magenta toner of the present invention includes the quinacridone-based pigment represented by the following General Formula (1):

[Chemical Formula 5]

(1)

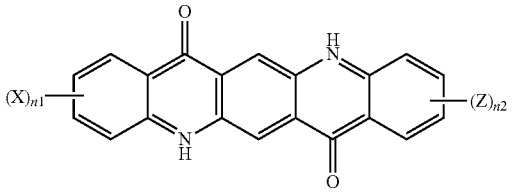

wherein X and Z are independently of each other a halogen atom, or an optionally substituted alkyl group or alkoxy group; and n1 and n2 are an integer of 0-4, respectively.

Herein, the halogen atom may include, for example, a fluorine atom, a chlorine atom, a bromine atom, an iodine atom and the like. The alkyl group may include preferably an alkyl group having 1-6 carbon atoms, for example, a methyl group, an ethyl group, an n-propyl group and the like, but not particularly limited thereto. The alkoxy group may include preferably an alkoxy group having 1-6 carbon atoms, for example, a methoxy group, an ethoxy group, an n-propoxy group and the like, but not particularly limited thereto. The alkyl group and the alkoxy group may have a substituent such as for example, a halogen atom. Preferably, n1 and n2 may be 0, or each of n1 and n2 is 1, and X and Z are a halogen atom, or an alkyl group having 1-6 carbon atoms.

As this quinacridone-based pigment, various known pigments may be used. For example, an unsubstituted quinacridone pigment having no substituent, a substituted quinacridone pigment having a substituent, a solid solution quinacridone pigment including a combination of those having different substituents, and the like are known, which may be all preferably used. The representative example thereof may include specifically C. I. Pigment Violet 19 (unsubstituted quinacridone), C. I. Pigment Red 122 (2,9-dimethylquinacridone), C. I. Pigment Red 202 (2,9-dichloro quinacridone), C. I. Pigment Red 207, C. I. Pigment Red 209 (3,10-dichloroquinacridone), and the like. These quinacridone-based pigments may be used alone or in combination of two or more.

[Metal Element-Containing Monoazo Pigment]

The magenta toner of the present invention includes the metal element-containing monoazo pigment represented by the following General Formula (2) or (2'). The metal element-containing monoazo pigment is obtained by laking a pigment, and includes metal ions.

[Chemical Formula 6]

(2)

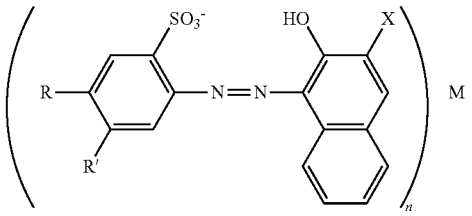

(2')

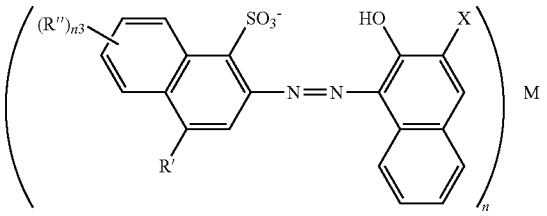

wherein R and R' denote a hydrogen atom, a halogen atom, or an optionally substituted alkyl group or alkoxy group; R" denotes a halogen atom, or an optionally substituted alkyl group or alkoxy group; n3 is an integer of 0-4; X is a hydrogen atom or a carboxylic acid anion; M is a monovalent or divalent metal ion; and n is a number determined by a valence number of X and M so that the metal element-containing monoazo pigment is electrically neutral. When X is a hydrogen atom, M is a monovalent or divalent metal ion, and when M is a monovalent metal ion, n is 1, and when M is a divalent metal ion, n is 2. When X is a carboxylic acid anion, M is a divalent metal ion, and n is 1. In General Formula (2'), each R" may be identical to or different from each other.

The halogen atom may include, for example, a fluorine atom, a chlorine atom, a bromine atom, an iodine atom and the like. The alkyl group is not particularly limited, but the alkyl group having 1-6 carbon atoms is preferred, and the alkoxy group is preferably the alkoxy group having 1-6 carbon atoms. The specific forms of the alkyl group and alkoxy group are similar to those described above. The alkyl group and alkoxy group may have a substituent such as a halogen atom. Particularly preferably, in General Formula (2), R is a methyl group, R' is a chlorine atom, and X is a carboxylic acid anion. In addition, in General Formula (2'), preferably R' and X are a hydrogen atom, and do not have R" (n3 is 0).

M is not particularly limited as long as it is a monovalent or divalent metal ion, but Ba, Sr, Ca, Mn, Na and the like are preferably used, and more preferably Sr, Ca or Na, still more preferably Ca or Sr, and particularly preferably Sr is used.

As the metal element of the metal element-containing monoazo pigment, Ba, Sr, Ca, Mn, Na and the like are used a lot, and among them, the positive charge strength (ionization tendency) is in the order of Ba>Sr>Ca>Na>Mn, and further, blue tends to be strong (the blue of Ba is the strongest among them), and saturation tends to be low (the saturation of Ba is the lowest among them) in this order. Meanwhile, when the positive charge is unduly strong, chargeability is lowered, and scattering performance is deteriorated, and thus, Ca or Sr, particularly Sr is more preferred.

In General Formula (2) or (2'), n is an integer of 1 or 2, when X is a hydrogen atom, n corresponds to the valence number of metal ion M. When X is a monovalent anion, carboxylic acid anion, the metal ion M is a divalent cation, and n is 1.

The specific examples of the metal element-containing monoazo pigment represented by General Formula (2) or (2') may include specifically C. I. Pigment Red 48:1, C. I. Pigment Red 48:2, C. I. Pigment Red 48:3, C. I. Pigment Red 48:4, C. I. Pigment Red 49, C. I. Pigment Red 49:1, C. I. Pigment Red 49:2, C. I. Pigment Red 49:3, C. I. Pigment Red 52:1, C. I. Pigment Red 53:1, C. I. Pigment Red 57:1 and the like.

The metal element-containing monoazo pigment represented by General Formula (2) or (2') may be a commercial product, or prepared by forming a pigment by laking a monoazo dye or metal element-containing monoazo dye. As a precipitator (lake metal salt) for laking a monoazo dye or metal element-containing monoazo dye, salts of calcium, barium, strontium or manganese, for example, barium chloride, calcium chloride, strontium chloride, manganese chloride and the like, may be listed. Thus, the problem that a dye component is eluted to contaminate the inside of a device such as a photoreceptor and a fixing device, or the toner is agglomerated under high temperature and high humidity environment may be avoided. For the specific order of laking, conventionally known knowledge may be properly referred to.

To the metal element-containing monoazo pigment, a rosin compound may be added as an additive, for imparting dispersion stability and a coloring property. That is, it is preferred in the magenta toner of the present invention that the metal element-containing monoazo pigment includes a rosin compound. By using the rosin compound, the dispersibility of the pigment may be improved in a process of dispersing the coloring agent, thereby improving the coloring property. In addition, the dispersibility of the coloring agent in the toner base particles may be improved to make the chargeability of the toner uniform, and thus, it is preferred to use the rosin compound.

The rosin compound may include natural rosin such as tall oil rosin, gum rosin and wood rosin, modified rosin such as hydrogenated rosin, disproportionated rosin and polymerized rosin, synthetic rosin such as styrene acryl rosin, and also an alkali metal salt or ester compound of the rosin. As the specific component, it is preferred to include abietic acid, neoabietic acid, dehydroabietic acid, dihydroabietic acid, pimaric acid, isopimaric acid, levopimaric acid and palustrinic acid, and an alkali metal salt or ester compound thereof, in particular an alkali metal salt thereof, in terms of the compatibility with the binder resin. By using this rosin compound, the dispersibility of the coloring agent may be improved, a color development property of the toner may be improved.

The method of treating the metal element-containing monoazo pigment by the rosin compound as described above is not particularly limited, but the following may be mentioned: (1) a dry mixing method including dry mixing a rosin compound and a metal element-containing monoazo pigment, and then subjecting the mixture to heat treatment such as melt kneading as required, and (2) a wet treatment method including adding an aqueous alkali solution of rosin to a synthetic solution of a metal element-containing monoazo pigment during preparation of the metal element-containing monoazo pigment, then adding a lake metal salt such as the salt of calcium, barium, strontium or manganese, and insolubilizing the rosin compound, thereby subjecting the surface of the metal element-containing monoazo pigment to coating treatment. In the present invention, the method of (2) may be particularly preferably used.

The throughput of the rosin compound to the metal element-containing monoazo pigment can be the amount by which the rosin compound in the metal element-containing monoazo pigment after the treatment is 1-40% by mass, preferably 5-30% by mass, more preferably 10-20% by mass, and this throughput may further improve dispersibility.

Besides, the quinacridone-based pigment represented by General Formula (1), or the naphthol AS-based pigment represented by General Formula (3) may be subjected to rosin treatment, in addition to the metal element-containing monoazo pigment.

The used amount of the metal element-containing monoazo pigment is not particularly limited as long as the combined content of the quinacridone-based pigment and the metal element-containing monoazo pigment is 50-90% by mass of the total coloring agent. Preferably, in the case that the metal element-containing monoazo pigment includes strontium as the metal element, M, the strength of strontium is preferably 100-1500 kcps, more preferably 100-1000 kcps, in the fluorescent X-ray analysis of the toner. The strength of strontium may be adjusted by the added amount of the metal element-containing monoazo pigment. When the strength of strontium is 100 kcps or more, a sufficient amount of the metal element may be secured, and thus, fixability of image quality is excellent. In addition, when 1500 kcps or less, positive charge is not excessively strong, and thus, chargeability is excellent, and scattering performance is good. Thus, the range is preferred. Further, when the metal element-containing monoazo pigment includes calcium as the metal element, M, the strength of calcium of 100-1500 kcps in the fluorescent X-ray analysis of the toner is preferred. In the case that the metal element-containing monoazo pigment includes sodium as the metal element, M, the strength of sodium of 100-1500 kcps in the fluorescent X-ray analysis of the toner is preferred. In addition, the strength of the metal element such as strontium in the fluorescent X-ray analysis of the toner may be measured by the method described in the Examples.

Besides, in the case that the metal element, M is a monovalent or divalent metal other than the above also, the strength of the element of 100-1500 kcps in the fluorescent X-ray analysis of the toner is preferred.

[Naphthol AS-Based Pigment]

The magenta toner of the present invention further includes the naphthol AS-based pigment represented by the following General Formula (3). In addition, the naphthol AS-based pigment in the present specification is a pigment having no metal element.

[Chemical Formula 7]

(3)

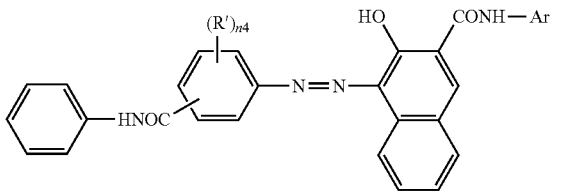

wherein R' is an optionally substituted alkyl group or alkoxy group; n4 is an integer of 0-4; and Ar is a hydrogen atom, an optionally substituted aryl group, or the following:

[Chemical Formula 8]

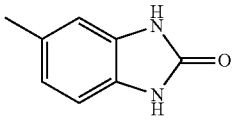

In General Formula (3), each R' may be the same or different.

The alkyl group is not particularly limited, but an alkyl group having 1-6 carbon atoms is preferred, and as the alkoxy group, an alkoxy group having 1-6 carbon atoms is preferred. The specific form of the alkyl group and the alkoxy group is similar to the above. The alkyl group and the alkoxy group may have a substituent such as a halogen atom. Particularly, R' is preferably an alkoxy group having 1-6 carbon atoms, and n4 is preferably 1.

The aryl group is not particularly limited, but may be a phenyl group, a naphthyl group and the like. The aryl group may have a substituent, and the substituent may include a halogen atom, a nitro group, an alkyl group, an alkoxy group and the like.

The specific example of the naphthol AS-based pigment represented by General Formula (3) may include C. I. Pigment Red 31, C. I. Pigment Red 146, C. I. Pigment Red 147, C. I. Pigment Red 150, C. I. Pigment Red 176, C. I. Pigment Red 184, C. I. Pigment Red 238, C. I. Pigment Red 269, and the like.

In the magenta toner of the present invention, the combined content of the quinacridone-based pigment represented by General Formula (1) and the metal element-containing monoazo pigment represented by General Formula (2) or (2') is 50-90% by mass of the total coloring agent. When the combined content of the quinacridone-based pigment represented by General Formula (1) and the metal element-containing monoazo pigment represented by General Formula (2) or (2') is less than 50% by mass of the total coloring agent, low temperature fixability, scattering properties, light fastness, and a GI value are lowered. Meanwhile, when more than 90% by mass, low temperature fixability, scattering properties, and saturation are lowered. The combined content is preferably 55-85% by mass, more preferably 55-70% by mass, based on the total coloring agent. In addition, the content of each coloring agent used in the toner of the present invention, in the present specification uses the value not including the additive such as the rosin compound.

Preferably, in the magenta toner of the present invention, the mass ratio of the quinacridone-based pigment and the metal element-containing monoazo pigment (quinacridone-based pigment: metal element-containing monoazo pigment) is 8:2 to 4:6. Since the crystal of the quinacridone-based pigment is very stable, light fastness is excellent. Thus, when the content of the quinacridone-based pigment is 40 parts by mass or more, based on total 100 parts by mass of the quinacridone-based pigment and the metal element-containing monoazo pigment, a magenta toner having excellent light fastness may be obtained. In addition, since the content of the metal element is not unduly high, charges as the toner may be sufficiently retained, a charge amount may be maintained, thereby reducing a toner scattering amount. Meanwhile, when the quinacridone-based pigment is contained in the toner, a filler effect is developed. That is, when heat is applied to the toner, elasticity is not decreased and tends to be maintained. It is preferred that the content of the quinacridone-based pigment is 80 parts by mass or less, relative to the total 100 parts by mass of the quinacridone-based pigment and the metal element-containing monoazo pigment, since deterioration of low temperature fixability caused by the filler effect may be suppressed. More preferably, the mass ratio of the quinacridone-based pigment and the metal element-containing monoazo pigment (quinacridone-based pigment: metal element-containing monoazo pigment) is 6:4 to 4:6.

The magenta toner of the present invention may use another coloring agent for color adjustment, for example, in a range of less than 20% by mass of the total amount of the coloring agent, in addition to the quinacridone-based pigment represented by General Formula (1), the metal element-containing monoazo pigment represented by General Formula (2) or (2'), and the naphthol AS-based pigment represented by General Formula (3). Another coloring agent may include C. I. Pigment Red 5, C. I. Pigment Red 144, C. I. Pigment Red 149, C. I. Pigment Red 166, C. I. Pigment Red 177, C. I. Pigment Red 178, C. I. Pigment Red 222, and the like. In addition, a yellow or cyan pigment may be used in combination. The yellow pigment may include C. I. Pigment Red 17, 74, 155, 180, 185, and the like. The cyan pigment may include C. I. Pigment Blue 15, 15:1, 15:2, 15:3, 15:4, 15:6, and the like.

Among the coloring agents used in the magenta toner of the present invention, the combined content of the quinacridone-based pigment represented by General Formula (1), the metal element-containing monoazo pigment represented by General Formula (2) or (2'), and the naphthol AS-based pigment represented by General Formula (3) is, for example, 80-100% by mass, preferably 90-100% by mass, more preferably 95-100% by mass, relative to the total content of the coloring agents.

When the toner base particles include a release agent, it is preferred that the total content of the coloring agents is 5-10% by mass, based on total 100% by mass of the binder resin and the release agent. When the total content of the coloring agents is 5% by mass or more, based on total 100% by mass of the binder resin and the release agent, a toner having excellent saturation may be obtained. Further, 10% by mass or less is also preferred, since fixability and scattering performance are excellent.

<Release Agent (Wax)>

The release agent (wax) is not particularly limited, but polyolefin-based wax such as low molecular weight polypropylene, polyethylene, or oxidized type polypropylene and polyethylene, and ester-based wax such as behenyl behenate may be preferably used.

Specifically, for example, polyolefin wax such as polyethylene wax and polypropylene wax; branched chain type hydrocarbon wax such as microcrystalline wax; long chain hydrocarbon-based wax such as paraffin wax and sasol wax; dialkylketone-based wax such as distearylketone; ester-based wax such as carnauba wax, montan wax, behenyl behenate, trimethylolpropane tribehenate, pentaerythritol tetrabehenate (pentaerythritol tetrabehenic acid ester), pentaerythritol diacetate dibehanate, glycerin tribehenate, 1,18-octadecanediol distearate, tristearyl trimellitate and distearyl maleate; amide-based wax such as ethylene diamine behenylamide and trimellitic acid tristearylamide, and the like may be listed. Among them, it is preferred to use those having a low melting point, specifically a melting point of 40-90° C., in view of a releasing property in low temperature fixation. The content ratio of the release agent is preferably 1-20% by mass, more preferably 5-20% by mass, in the toner base particles.

(Charge Control Agent)

In the toner base particles of the present embodiment, other internal additives such as a charge control agent may be contained as required. As the charge control agent, various known compounds may be used.

The content ratio of the charge control agent is regarded as being generally 0.1-10 parts by mass, preferably 0.5-5 parts by mass, based on 100 parts by mass of the finally obtained binder resin.

(External Additive Particle)

The toner according to the present invention may include external additive particles, in addition to the toner base particles. As the external additive particles, conventionally known external additive particles may be used. These external additive particles may include, for example, inorganic oxide particles including silica particles, alumina particles and titania particles, inorganic stearate compound particles such as aluminum stearate particles and zinc stearate particles, or inorganic titanate compound particles such as strontium titanate and zinc titanate, and the like. These may be used alone or in combination of two or more. It is preferred that these inorganic particles are subjected to gloss treatment by a silane coupling agent or titanium coupling agent, a high fatty acid, silicone oil and the like, for improving thermal resistant storability and environmental stability.

(Glass Transition Temperature of Toner)

The toner according to the present invention has a glass transition temperature (Tg) of preferably 25-65° C., more preferably 35-55° C. Within the range of the glass transition temperature of the toner of the present invention, sufficient low temperature fixability and thermal resistant storability may be compatible. The glass transition temperature of the toner is measured similarly to the above, except for using the toner as a measurement sample.

(Particle Diameter of Toner)

The toner according to the present invention has an average particle diameter of preferably 3-8 μm, more preferably 5-8 μm, for example, as a median diameter by volume, in the toner base particles (toner particles having no external additive). This average particle diameter may be controlled by the concentration of a coagulant used in the preparation, the added amount of an organic solvent, fusion time, the composition of the binder resin, and the like. Within the range of the median diameter by volume, a very small dot image at a 1200 dpi level may be faithfully reproduced. The median diameter based on the volume of the toner base particles may be measured and calculated using a measuring device connected to a computer system of "Multisizer 3" (manufactured by Beckman Coulter, Inc.) with software for data processing, "Software V 3.51". Specifically, 0.02 g of a measurement sample (toner base particles) is added to 20 mL of a surfactant solution (for example, a surfactant solution in which a neutral detergent containing a surfactant component is diluted 10-fold with pure water, for dispersing the toner base particles) to be compatible therewith, and then ultrasonic dispersion is carried out for 1 minute, thereby preparing a toner dispersion, which is injected to a beaker containing "ISOTONII" (manufactured by Beckman Coulter, Inc.) in a sample stand with a pipette until a display concentration of the measuring device is 8%. Here, within this concentration range, a reproducible measurement value may be obtained. Further, in the measuring device, the measured particle count number is 25000, and an aperture diameter is 100 μm, and the measurement range of 2-60 μm is divided into 256 to calculate a frequency value, and the particle diameter at 50% from the side having a higher volume cumulative fraction is taken as a median diameter by volume.

(Average Circularity of Toner)

In the toner according to the present invention, for each toner particle forming this toner, the toner base particle (toner particles containing no external additive) has an average circularity of preferably 0.930-1.000, more preferably 0.950-0.995, in view of the stability of charging characteristics and low temperature fixability. Within the range of the average circularity, each toner particle is more difficult to be crushed, so that the contamination of friction charging imparting members is suppressed to stabilize chargeability of the toner, and further, the image quality of the image to be formed is higher. The average circularity of the toner base particles is a value measured using "FPIA-2100" (manufactured by Sysmex). Specifically, it is a value obtained as follows: a measurement sample (toner) is applied to an aqueous solution containing a surfactant to be compatible, and subjected to ultrasonic dispersion treatment for 1 minute to be dispersed, and then photographing is performed at an appropriate concentration of the HPF detection number of 3,000-10,000, in a measurement condition of HPF (high magnification imaging) mode, by "FPIA-2100" (manufactured by Sysmex), the circularity is calculated to each toner base particle according to the following equation, and the circularity of each toner base particle is added, which is divided by the number of total toner base particles. Within the range of the HPF detection number, reproducibility is obtained.

Circularity=(Perimeter of a circle having the same projected area as a particle image)/(perimeter of particle projected image)

Besides, it is preferred that the toner particles after adding the external additive also have a similar average circularity.

<Preparation Method of Toner>

<Preparation Method of Toner Base Particle>

In the toner according to the present invention, the toner base particles may be prepared by, for example, an emulsion aggregation method. The preparation method to be used when the toner base particles are prepared by the emulsion aggregation method includes for example, the following processes: adding (a) an aqueous dispersion including amorphous resin particles, (b) an aqueous dispersion including crystalline polyester resin particles, and (c) an aqueous dispersion of coloring agent particles to an aqueous medium to prepare a mixed dispersion; and heating the mixed dispersion to agglomerate the amorphous resin particles and the crystalline resin particles together with the coloring agent particles to form toner base particles. In addition, the "aqueous medium" in the present specification refers to a medium containing at least 50% by mass or more of water, and as the components other than water, a water-soluble organic solvent may be mentioned. For example, methanol, ethanol, isopropanol, butanol, acetone, methylethyl ketone, dimethyl formamide, methyl cellosolve, tetrahydrofuran, and the like may be listed. Among them, it is preferred to use an alcohol-based organic solvent such as methanol, ethanol, isopropanol and butanol, which does not dissolve the resin. Preferably, only water is used as the aqueous medium.

The above preparation method may include, for example, each of the following processes. Herein, the following example is for the case that the amorphous resin particles contain a release agent, and the technical scope of the present invention is not limited to this form:

(1) preparation of (a) an aqueous dispersion, in which (a) an aqueous dispersion including amorphous resin particles containing a release agent is prepared, (2) preparation of (b) an aqueous dispersion, in which a crystalline polyester resin is dissolved in an organic solvent, and emulsified and dispersed in an aqueous medium to remove the organic solvent, thereby preparing (b) an aqueous dispersion including crystalline polyester resin particles, (3) preparation of (c) an aqueous dispersion, in which a coloring agent is dispersed in an aqueous medium to prepare (c) an aqueous dispersion of coloring agent particles, (4) preparation of a mixed dispersion, in which (a) the aqueous dispersion prepared in the above (1), (b) the aqueous dispersion prepared in the above (2), and (c) the aqueous dispersion prepared in the above (3) are added to the aqueous medium to prepare a mixed dispersion, (5) formation of agglomerated particles, in which the mixed dispersion prepared in the above (4) is heated to agglomerate the amorphous resin particles, the crystalline polyester resin particles, and the coloring agent particles, thereby forming toner base particles, (6) aging, in which the agglomerated particles formed in the above (5) are aged by thermal energy to control the shape, thereby obtaining the toner base particles, (7) cooling, in which the dispersion of toner base particles is cooled, (8) filtering/cleaning, in which the toner base particles are filtered out from the aqueous medium to remove the surfactant and the like from the toner base particles, and (9) drying, in which the cleaned toner base particles are dried.

As such, the toner base particles according to the present invention may be prepared by essential processes of (1)-(5), and further processes of (6)-(9), which may be added as required.

In carrying out each process as described above, conventionally known knowledge may be properly referred to. For example, (a) the aqueous dispersion including the amorphous resin particles as described above, or (b) the aqueous dispersion including the crystalline polyester resin particles may be prepared using various emulsification methods such as emulsification by mechanical shearing force, however, it is preferred to use a method referred to as phase inversion emulsification. In particular, for (b) the aqueous dispersion, in the case of using the phase inversion emulsification method, the carboxyl group stability of the crystalline polyester resin is changed, thereby uniformly dispersing oil droplets, and the dispersion is excellent in that it is not forcibly formed by shearing force as in the mechanical emulsification method. In "the phase inversion emulsification method", the aqueous dispersion of the resin particles is obtained, through a dissolution process of dissolving the resin in an organic solvent to obtain a resin dissolved solution, a neutralization process of adding a neutralizing agent to the resin dissolved solution, an emulsification process of emulsifying and dispersing the resin dissolved solution after neutralization in the aqueous medium to obtain a resin emulsion, and a desolvation process of removing the organic solvent from the resin emulsion. Besides, the diameter of the resin particles in the aqueous dispersion may be controlled by changing the added amount of the neutralizing agent.

Even when preparing (c) the aqueous dispersion of the coloring agent particles, a surfactant may be added, for improving dispersion stability of the coloring agent particles. In addition, mechanical energy may be used in dispersion treatment. This dispersing machine is not particularly limited, but may include an ultrasonic dispersing machine such as a low speed shearing type dispersing machine, a high speed shearing type dispersing machine, a friction type dispersing machine, a high pressure jet type dispersing machine, an ultrasonic homogenizer and the like, or a high pressure impact type dispersing machine, Ultimizer, and the like.

In addition, the total content of the coloring agent in (c) the aqueous dispersion of the coloring agent particles is preferably in a range of 5-50% by mass, more preferably in a range of 10-40% by mass. Within this range, an effect of securing color reproducibility may be exhibited.

The coloring agent particles in (c) the aqueous dispersion have a median diameter by volume in a range of preferably 10-300 nm, more preferably 100-250 nm.

In addition, the median diameter by volume of the coloring agent particles may be measured, using a measuring device connected to a computer system of Multisizer 3 (manufactured by Beckman Coulter, Inc.) with software for data processing, Software V 3.51.

Specifically, 0.02 g of a sample (coloring agent particles) was added to 20 mL of a surfactant solution (for example, a surfactant solution in which a neutral detergent containing a surfactant component is 10-fold diluted with pure water) to be compatible therewith, and then ultrasonic dispersion treatment for 1 minute is performed, thereby preparing a dispersion of the coloring agent particles. This dispersion is injected to a beaker containing ISOTONII (manufactured by Beckman Coulter, Inc.) in a sample stand with a pipette, until the display concentration of the measuring device is 8%. Within this concentration, a reproducible measurement value may be obtained.

Further, in the measuring device, the measured particle count number is 25000, and an aperture diameter is 100 μm, and the measurement range of 2-60 μm is divided into 256 to calculate a frequency value, and the particle diameter at 50% from the side having a higher volume cumulative fraction is taken as a median diameter by volume.

In addition, the toner base particles having a core shell structure may be prepared by providing a shell layer on the surface of the toner base particles as a core. With the core shell structure, thermal resistant storability and low temperature fixability may be further improved. In addition, since the distribution of a charge amount is broadened, when using the coloring agent, good image quality may be obtained. For preparing the toner base particles having a core shell structure, for example, in the preparation method as described above, the following process is carried out after forming the agglomerated particles in the above process of (5), and then the process of (6) and the subsequent processes are carried out:

(5') using the toner base particles prepared in the above (5) as core particles, and adding (d) an aqueous dispersion for a shell including amorphous resin particles to the mixed dispersion to form the shell on the surface of the core particles.

<Preparation Method of Toner Particles>

(Process of Adding External Additive)

A process of adding the external additive is a process of adding external additive particles to toner base particles subjected to drying treatment, and mixing them, thereby preparing toner particles. As a method of adding the external additive, a dry method of adding a powdered external additive to dried toner base particles may be mentioned, and as a mixing apparatus, a mechanical mixing apparatus such as a Henschel mixer and a coffee mill may be mentioned.

<Developer for Developing Electrostatic Charge Image>

The toner according to the present invention may be used as a magnetic or non-magnetic one-component developer, however, may be also used as a two-component developer by mixing it with a carrier. When the toner is used as the two-component developer, magnetic particles including conventionally known materials, for example, metals such as iron, ferrite, magnetite, and an alloy of these metals with a metal such as aluminum and lead may be used as the carrier, and in particular, ferrite particles are preferred. In addition, as the carrier, a coating carrier in which the surface of magnetic particles is coated with a coating agent such as a resin, a dispersion type carrier formed by dispersing magnetic fine powder in the binder resin, or the like may be used.

The carrier is regarded as having a median diameter by volume of preferably 20-100 μm, more preferably 25-80 μm. The median diameter by volume of the carrier may be measured by "HELOS" (manufactured by SYMPATEC) which is a laser diffraction type particle size distribution measuring device equipped with a wet dispersing machine.

In addition, the "toner" according to the present invention contains "toner base particles" as described above. The "toner base particle" is referred to as a "toner particle" by the addition of the external additive. Further, the "toner" refers to an aggregate of "toner particles".

<Electrophotographic Imaging Method>

The developer for developing electrostatic charge image according to the present invention may be used in the known various electrophotographic imaging methods. For example, in a full-color imaging method, such as a 4-cycle type imaging method including 4 kinds of color developing devices for each of yellow, magenta, cyan and black, and one electrostatic charge image carrier (also referred to as "electrophotographic photoreceptor" or simply "photoreceptor"), or a tandem type imaging method with imaging units for each color having a color developing device for each color and an electrostatic charge image carrier, the developer may be used in all imaging methods as a magenta developer.

As the electrophotographic imaging method, specifically, for example, an electrostatic charge image electrostatically formed by for example, being charged on the electrostatic charge image carrier by a charging device (charging process), and being image-exposed (light exposing process), using the developer for developing an electrostatic charge image according to the present invention is developed by charging the toner by the carrier in the developer for developing an electrostatic charge image according to the present invention, in the developing device, thereby obtaining a toner image (developing process). Further, this toner image is transferred to paper (transfer process), and thereafter, the toner image transferred on the paper is fixed on the paper by fixation treatment in a contact heating manner (fixing process), thereby obtaining a visible image.

EXAMPLES

The effect of the present invention is described using the following Examples and Comparative Examples. In the following Examples, unless otherwise stated, "part" and "%" mean "part by mass" and "% by mass", respectively, and each operation is carried out at room temperature (25° C.). In addition, the present invention is not limited to the following Examples.

<Manufacture of Toner>

Preparation Example 1: Synthesis of Crystalline Polyester Resin (1)

To a 5 L reaction vessel with a stirrer, a temperature sensor, a cooling tube and a nitrogen introduction device, 281 parts by mass of tetradecane diacid, and 206 parts by mass of 1,6-hexanediol were added, and the internal temperature was raised to 190° C. for 1 hour while stirring this system. After confirming a uniformly stirred state, $Ti(OBu)_4$ as a catalyst was added thereto in an amount of 0.003% by mass based on 100% by mass of the added amount of tetradecane diacid. Thereafter, the internal temperature was raised from 190° C. to 240° C. for 6 hours while removing produced water by distillation, and again, a dehydration condensation reaction was continued under the condition of 240° C. for 6 hours to perform polymerization, thereby obtaining a crystalline polyester resin (1). The crystalline polyester resin (1) had an acid value of 20 mgKOH/g, and a number average molecular weight (Mn) of 4400.

Preparation Example 2: Synthesis of Crystalline Polyester Resin (2)

A crystalline polyester resin (2) was obtained in a similar manner to Preparation Example 1, except that the composition of the raw material monomer was changed to 267 parts by mass of dodecane diacid, and 206 parts by mass of 1,9-nonanediol. The crystalline polyester resin (2) had an acid value of 15 mgKOH/g, and a number average molecular weight (Mn) of 4500.

Preparation Example 3: Synthesis of Crystalline Polyester Resin (3)

A crystalline polyester resin (3) was obtained in a similar manner to Preparation Example 1, except that the composition of the raw material monomer was changed to 281 parts by mass of dodecane diacid, and 145 parts by mass of 1,9-nonanediol. The crystalline polyester resin (3) had an acid value of 30 mgKOH/g, and a number average molecular weight (Mn) of 7500.

Preparation Example 4: Synthesis of Hybrid Crystalline Polyester Resin (4)

A raw material monomer and a radical polymerization initiator of a vinyl polymerization segment (styrene acryl polymerization segment: StAc segment) having the following composition, including a both reactive monomer were added to a dropping funnel.

| | |
|---|---|
| styrene | 34 parts by mass |
| n-butyl acrylate | 12 parts by mass |
| acrylic acid | 2 parts by mass |
| polymerization initiator (di-t-butyl peroxide) | 7 parts by mass. |

Further, the following raw material monomer of the crystalline polyester polymerization segment (CPEs segment) was added to four-neck flask equipped with a nitrogen introducing tube, a dehydration tube, a stirrer, and a thermocouple, and heated to 170° C. to be dissolved.

| | |
|---|---|
| tetradecane diacid | 298 parts by mass |
| 1,6-hexanediol | 118 parts by mass. |

Next, the raw material monomer of the styrene acryl polymerization segment was added dropwise for 90 minutes while stirring the content of the flask, and aged for 60 minutes, and then the unreacted raw material monomer of the styrene acryl polymerization segment was removed under reduced pressure (8 kPa). In addition, the amount of the monomer removed at this time was very small as compared with the raw material monomer ratio of the resin.

Thereafter, 0.8 parts by mass of $Ti(OBu)_4$ was added thereto as an esterification catalyst, and heated to 235° C., and the reaction was carried out for 5 hours under atmospheric pressure (101.3 kPa), and again for 1 hour under reduced pressure (8 kPa).

Next, cooling to 200° C. was performed, and the reaction was carried out for 1 hour under reduced pressure (20 kPa), thereby obtaining a hybrid crystalline polyester resin (4). The content of the styrene acryl polymerization segment other than CPEs (HB ratio) was 10% by mass based on the total 100% by mass of the hybrid crystalline polyester resin (4), and also the resin was in the form in which the CPEs segment is grafted on the StAc segment. In addition, the hybrid crystalline polyester resin (4) had an acid value of 20 mgKOH/g and a number average molecular weight (Mn) of 6400.

Preparation Example 5: Synthesis of Amorphous Polyester Resin (1)

To a reactor with a cooling tube, a stirrer and a nitrogen introduction tube, 316 parts by mass of bisphenol A propylene oxide 2 mol adduct, 80 parts by mass of terephthalic acid, 34 parts by mass of fumaric acid, and 2 parts by mass of titanium tetraisopropoxide as a polycondensation catalyst were added in 10 portions, and reacted at 200° C. for 10 hours under nitrogen stream while removing water produced by distillation. Next, the reaction was carried out under reduced pressure of 13.3 kPa (100 mmHg), and the amorphous polyester resin (1) was obtained by taking it out when the softening point was 104° C. The amorphous polyester resin (1) had a weight average molecular weight (Mw) of 194,000, and glass transition temperature of 45° C.

Preparation Example 6: Preparation of Aqueous Dispersion of Crystalline Polyester Resins (1)-(3), Hybrid Crystalline Polyester Resin (4), and Amorphous Polyester Resin (1) Particles 100 parts by mass of the crystalline polyester resin (1) was dissolved in 400 parts by mass of ethyl acetate. Next, 25 parts by mass of a 5.0% by mass aqueous sodium hydroxide solution was added to form a resin solution. This resin solution was added to a container having a stirring apparatus, and 400 parts by mass of a 0.26% by mass aqueous lauryl sodium sulfate solution was added dropwise and mixed for 30 minutes, while stirring the resin solution. During the dropwise addition of the aqueous lauryl sodium sulfate solution, the solution in the reaction vessel became turbid. In addition, the whole amount of the aqueous lauryl sodium sulfate solution was added dropwise, thereby preparing an aqueous dispersion having a solid content of 20% by mass in which resin particles are uniformly dispersed.

For other resins, aqueous dispersions having a solid content of 20% by mass were obtained by a similar operation.

Preparation Example 7: Preparation of Aqueous Dispersion of Wax-containing Vinyl Resin (1) Particles □First Stage Polymerization□

To a reaction vessel with a stirring apparatus, a temperature sensor, a cooling tube and a nitrogen introduction device, a solution of 8 parts by mass of dodecyl sodium sulfate dissolved in 3000 parts by mass of ion exchange water was added, and the internal temperature was raised to 80° C., while stirring the reactant at a stirring speed of 230 rpm under nitrogen stream. After heating, a solution of 10 parts by mass of potassium persulfate dissolved in 200 parts by mass of ion exchange water was added, the solution temperature was 80° C. again, the monomer mixed solution including the following monomer was added dropwise for 1 hour, and polymerization was performed by heating at 80° C. for 2 hours, and stirring, thereby preparing an aqueous dispersion of resin particles (1H).

| | |
|---|---|
| styrene (St) | 480 parts by mass |
| n-butyl acrylate(BA) | 250 parts by mass |
| methacrylic acid (MAA) | 68 parts by mass |
| n-octyl-3-mercaptopropionate | 16 parts by mass. |

□Second Stage Polymerization□

The following monomer mixed solution was heated to 90° C. with stirring, and 192 parts by mass of pentaerythritol tetrabehenic acid ester as a release agent (wax) was dissolved in this mixed solution, thereby preparing a wax-containing monomer mixed solution.

| | |
|---|---|
| styrene | 246.4 parts by mass |
| n-butyl acrylate | 118.6 parts by mass |
| n-octyl-3-mercaptopropionate | 1.44 parts by mass. |

To a reaction vessel with a stirring apparatus, a temperature sensor, a cooling tube and a nitrogen introduction device, a solution of 7 parts by mass of polyoxyethylene (2) dodecyl ether sodium sulfate dissolved in 800 parts by mass of ion exchange water was added, and heated to 98° C., and 260 parts by mass of the dispersion of resin particles (1H) and the wax-containing monomer mixed solution were added thereto, and mixing and dispersing were carried out for 1 hour with a mechanical disperser, "CLEARMIX" (manufactured by M Technique Co., Ltd.) having a circulation path, thereby preparing an aqueous dispersion including emulsified particles (oil droplets).

Next, to this aqueous dispersion, an initiator solution of 6 parts by mass of potassium persulfate dissolved in 200 parts by mass of ion exchange water was added, and polymerization was performed by heating and stirring this system at 82° C. for 1 hour, thereby preparing the aqueous dispersion of resin particles (1HM).

□Third Stage Polymerization□

Further, to the aqueous dispersion of resin particles (1HM) obtained above, a solution of 11 parts by mass of potassium persulfate dissolved in 400 parts by mass of ion exchange water was added, and under the condition of the temperature of 82° C., a monomer mixed solution including:

| | |
|---|---|
| styrene | 428.1 parts by mass |
| n-butyl acrylate | 129.9 parts by mass |
| methacrylic acid | 32.5 parts by mass |
| n-octyl-3-mercaptopropionate | 8.0 parts by mass |

was added dropwise for 1 hour. After finishing dropwise addition, polymerization was performed by heating and stirring for 2 hours, and cooling to 28° C. was performed, thereby preparing an aqueous dispersion of wax-containing vinyl resin (1) particles.

Preparation Example 8: Preparation of Aqueous Dispersion of Coloring Agent Particles 90 parts by mass of lauryl sodium sulfate was added to 1600 parts by mass of ion exchange water. While stirring this solution, the coloring agent was slowly added thereto, and then, dispersion treatment was performed using a stirring apparatus, "CLEARMIX" (manufactured by M Technique Co., Ltd.), thereby preparing an aqueous dispersion of coloring agent particles. The coloring agent particles included in the aqueous dispersion had a solid content of 13.0% by mass, and the median diameter by volume of the coloring agent particles was all 220 nm.

In addition, as the coloring agent, a mixture of the pigments, shown in the following Table 1, which was previously mixed in predetermined ratios described in Table 1 was used. Among the metal element-containing monoazo pigments shown in the following Table 1, PR49:3 and PR48:3 used a rosin-treated pigment, and PR57:1 used a rosin-untreated pigment.

Rosin Treatment Procedure

In the process of preparing a metal element-containing monoazo pigment, a rosin compound was added when metal laked, and then a metal salt for a lake was added, thereby precipitating a rosin lake metal salt on the surface of the pigment.

For rosin treatment of PR48:3, 740 parts by mass of a 60% by mass aqueous solution of PR48:3 before metal lake was cooled to 0° C., 50 parts by mass of a 10% by mass aqueous rosin soda solution was added, and stirring was performed for 60 minutes, thereby obtaining a suspension. To this suspension, 31 parts by mass of strontium chloride dissolved in 90 parts by mass of water was added, and stirred for 60 minutes. Thereafter, heating at 70° C. was performed for 60 minutes with stirring, thereby obtaining a metal element-containing monoazo pigment suspension in water. The pH of this suspension was adjusted to 6.0. After filtering and cleaning the thus-obtained suspension, force of 4 kg/cm$^2$ was applied for compression, and drying at 40° C. was performed, thereby obtaining rosin-treated PR48:3.

The rosin treatment of PR49:3 was carried out in a similar order to the rosin treatment of PR48:3, except for using PR49:3 before metal lake, and 37 parts by mass of strontium chloride.

For PR57:1, a solution of 22 parts by mass of calcium chloride dissolved in 90 parts by mass of water was added to 620 parts by mass of a 60% by mass aqueous solution of PR57:1 before metal lake, and stirred for 60 minutes. Thereafter, heating at 70° C. was performed for 60 minutes with stirring, thereby obtaining a metal element-containing monoazo pigment suspension in water. The pH of this suspension was adjusted to 6.0. After filtering and cleaning the thus-obtained suspension, force of 4 kg/cm$^2$ was applied for compression, and drying at 40° C. was performed, thereby obtaining metal laked PR57:1.

Example 1: Manufacture of Toner 1

To a reaction vessel with a stirring apparatus, a temperature sensor and a cooling tube, 160 parts by mass (in terms of solid content) of an aqueous dispersion of wax-containing vinyl resin (1) particles, and 2000 parts by mass of ion exchange water were added, and then 5 mol/L of an aqueous sodium hydroxide solution was added, thereby adjusting the pH of the solution to 10.

Thereafter, 13 parts by mass (in terms of solid content, except a rosin compound) of aqueous dispersion of the magenta pigment in the following Table 1 was added thereto as the coloring agent. Here, the mixing ratio (mass ratio) of each magenta pigment was PR122/PR49:3/PR269=30/30/40, in terms of solid content (except a rosin compound). Next, an aqueous solution of 30 parts by mass of magnesium chloride dissolved in 30 parts by mass of ion exchange water was added at 30° C. for 10 minutes with stirring. Next, the reactant was allowed to stand for 3 minutes, 20 parts by mass (in terms of solid content) of an aqueous dispersion of crystalline polyester resin (1) particles was added for 10 minutes, and then heating up to 82° C. was performed over 60 minutes, and the particle growth reaction was continued while the temperature was maintained at 82° C. In this state, a diameter of agglomerated particles was measured by "Coulter Multisizer 3" (manufactured by Beckman Coulter, Inc.), cooling to 79° C. was performed when the median diameter by volume is 6.0 μm, 20 parts by mass (in terms of solid content) of an aqueous dispersion of amorphous polyester resin (1) particles was added for 30 minutes, cooling to 74° C. was performed when the supernatant of the reaction solution is clear, an aqueous solution of 190 parts by mass of sodium chloride dissolved in 760 parts by mass of ion exchange water was added to stop particle growth, heating to 74° C. and stirring were performed, thereby proceeding with fusion of particles, and an average circularity was measured (HPF detection number 4000) using a measuring device of average circularity of the toner, "FPIA-2100" (manufactured by Sysmex), and when the average circularity was 0.957, cooling to 30° C. was performed at a cooling rate of 2.5° C./min.

Next, solid-liquid separation was performed, the operation including redispersing a dehydrated toner cake in ion exchange water, and performing solid-liquid separation was repeated 3 times, and cleaning was performed, and then drying at 40° C. was performed for 24 hours, thereby obtaining toner base particles.

To 100 parts by mass of the obtained toner base particles, 0.6 parts by mass of hydrophobic silica (number average primary particle diameter=12 nm, hydrophobicity=68), and 1.0 parts by mass of hydrophobic titanium oxide (number average primary particle diameter=20 nm, hydrophobicity=63) were added, mixing was performed at 32° C. for 20 minutes, at a rotor blade peripheral speed of 35 mm/sec, by a "Henschel mixer" (manufactured by Mitsui Miike Chemical Engineering Machinery, Co., Ltd), and then removing course particles using a sieve with a 45 μm mesh was carried out, for performing an external additive treatment to the obtained toner base particles, thereby preparing Toner 1.

Examples 2-11 and 13-19, and Comparative Examples 1-6: Manufacture of Toners 2-11 and 13-25

Toners 2-11 and 13-25 were manufactured in a similar manner to the above Example 1, except that the coloring agent and the crystalline polyester resin were changed as shown in the following Table 1.

Example 12: Manufacture of Toner 12

(Preparation of Aqueous Dispersion of Wax-Containing Amorphous Polyester Resin (1) Particles)

100 parts by mass of the amorphous polyester resin (1) prepared above was added to 400 parts by mass of ethyl acetate (manufactured by Kanto Chemical Co., Inc.) with stirring to be dissolved, and 9.8 parts by mass of paraffin wax (melting point: 73° C.) and 5 parts by mass of a wax dispersing agent (manufactured by NOF CORPORATION, BP-70R sorbitan monobehenate) were added, and heated and dissolved.

Next, 638 parts by mass of a previously prepared lauryl sodium sulfate solution having a concentration of 0.26% by mass was mixed therewith, and ultrasonic dispersion was performed with stirring for 30 minutes at V-LEVEL 300 μA with an ultrasonic homogenizer "US-150T" (manufactured by NIHONSEIKI KAISHA LTD.).

Thereafter, in a heated state to 50° C., ethyl acetate was completely removed with stirring for 5 hours under reduced pressure, using a diaphragm vacuum pump V-700 (manufactured by BUCHI from Japan), thereby obtaining an "aqueous dispersion of wax-containing amorphous polyester resin (1) particles" having a solid content of 20% by mass.

Toner 12 was obtained in a similar manner to Toner 1, except that the aqueous dispersion of wax-containing vinyl resin (1) particles was changed to the above-prepared aqueous dispersion of wax-containing amorphous polyester resin (1) particles, in Toner 1 of Example 1.

<Manufacture of Developer for Developing Electrostatic Charge Image>

100 parts by mass of ferrite core, and 5 parts by mass of cyclohexylmethacrylate/methyl methacrylate (copolymerization ratio 5/5) copolymer resin particles were added to a high speed mixer with stirring blades, and stirred and mixed at 120° C. for 30 minutes to form a resin coating layer on the surface of a ferrite core by the action of mechanical impact force, thereby obtaining a carrier having a median diameter by volume of 35 nm.

The median diameter by volume of the obtained carrier was measured with a laser diffraction type particle size distribution measuring device, "HELOS" (manufactured by SYMPATEC) equipped with a wet dispersing machine. To the carrier, each of the Toners 1-25 manufactured in Examples 1-19 and Comparative Examples 1-6 was added so that the toner concentration was 6% by mass, which was added to a micro type V shaped mixer (manufactured by Tsutsui scientific instruments co., ltd.), and mixing at a rotation speed of 45 rpm was performed for 30 minutes, thereby manufacturing Developers 1-25.

(Fluorescent X-Ray Analysis (Strontium Amount Measurement))

The metal amount in the toner after adding the external additive was measured using a wavelength dispersive fluorescent X-ray analyzer, "XRF-1700" (manufactured by SHIMADZU CORPORATION). As a specific measurement method, 2 g of the toner was filled in a plastic ring, and pressure-molded with an automatic press to obtain a pelletized sample, and the measurement was carried out for 30 minutes using the sample under the measurement condition of the fluorescent X-ray analyzer of tube voltage of 40 kV and tube current of 90 mA. In the Toner of Example 1, it was 500 kcps as the intensity of the fluorescent X-ray analysis of strontium element.

(Evaluation of Low Temperature Fixability)

As an imaging device, a commercially available full-color multifunction printer, "Bizhub® C754" (manufactured by KONICA MINOLTA, INC.) which was modified so that the surface temperature of a fixing upper belt and a fixing lower roller may be changed, was used, and a test to output a beta image having a toner adhesion amount of 11.3 g/m$^2$ on a recording material, "Mondi Color Copy A4 90 g/m$^2$" (manufactured by Mondi) at a nip width of 11.2 mm, a fixing time of 34 msec, fixing pressure of 133 kPa, and fixing temperature of 100-200° C. was repeatedly carried out, under normal temperature and humidity environment (temperature of 20° C., humidity of 50% RH), until cold offset occurred, while changing the fixing temperature by 1° C. Further, the lowest surface temperature of the fixing upper belt in which cold offset does not occur was examined, which is set as a lowest fixing temperature, and the low temperature fixability was evaluated. In addition, for each test, the "fixing temperature" refers to a surface temperature of the fixing upper belt. In addition, it represents that the lower the lowest fixing temperature, the better the low temperature fixability. Herein, ○ or Δ was an acceptance level in the following evaluation:

○ . . . less than 140° C.

Δ . . . at least 140° C. less than 160° C.

x . . . 160° C. or more.

(Scattering Performance Evaluation)

A modified device of "Bizhub® C452" (manufactured by KONICA MINOLTA, INC.) was used as an evaluator to output 100,000 sheets, and then a developing device was taken out to be set in an idle device. Evaluation was performed by placing an A4 blank sheet at the center directly under a developing sleeve, and performing idling for 60 minutes to measure the mass of the toner dropped on the paper (toner scattering amount). A rotation peripheral speed of the developing sleeve was 620 mm/sec. If the following evaluation result was ○ or Δ, it may be used without problems.

○ . . . less than 10 mg

Δ . . . at least 10 mg less than 20 mg x . . . 20 mg or more.

(Image Quality)

A grayscale pattern of grayscale ratio of 32 levels was outputted, under a normal temperature and humidity environment (temperature 20° C., humidity 50% RH), using a commercially available color multifunctional printer, "bizhub PRO® C6500" (manufactured by KONICA MINOLTA, INC.), and to this grayscale pattern, Fourier transform processing considering MTF (Modulation Transfer Function) correction to the reading value by CCD was performed, and a GI value (Graininess Index) matching the human relative visibility was measured, thereby calculating the maximum GI value. The lower GI value is better. Herein, the GI value has been published in the Imaging Society of Japan, 39(2), 84•93(2000). If the following evaluation result was ○ or Δ, it may be used without problems.

○ . . . less than 0.190

Δ . . . at least 0.190 less than 0.220 x . . . 0.220 or more.

(Saturation)

A test chart for measuring color gamut was outputted in the default mode, using a commercially available color multifunctional printer, "bizhub PRO® C6500" (manufactured by KONICA MINOLTA, INC.), and the outputted test chart for measuring color gamut was measured with "Spectrolina/Scan Bundle (manufactured by Gretag Macbeth)". In addition, the evaluation of color gamut was performed by calculating saturation from the value obtained by manufacturing each beta image (2 cm×2 cm) of a magenta single color (M), measuring this beta image under the above measurement condition, and representing it on a L-a*-b* coordinate. The fixing temperature was (the lowest temperature in the fixability evaluation+20° C.), and the saturation at this fixing temperature was evaluated. If the following evaluation result was ○ or Δ, it may be used without problems.

○ . . . more than 75

Δ . . . 75-70 x . . . less than 70.

(Light Fastness)

An exposure test of the image outputted in the saturation evaluation was performed for 30 days with Ci4000 Weather-Ometer (manufactured by ATLUS CO., LTD.) (1 W/m$^2$ at 420 nm, tank internal temperature of 25° C., humidity of 50% RH). Again, the L-a*-b* coordinate of the image was measured, thereby calculating the color difference from the initial, $\Delta E_{00}$. The smaller the value, the better the light fastness of the image. Herein, ○ or Δ was an acceptance level in the following evaluation:

○ . . . less than 16

Δ . . . at least 16 less than 20 x . . . 20 or more.

The compositions of the toners of Examples and Comparative Examples, and the evaluation results thereof are shown in the following Table 1, and Table 2, respectively. In Table 1, the total content of pigment (% by mass) is % by mass (in terms of solid content) based on the combined mass of the total binder resin and the release agent. In addition, the content (% by mass) of the crystalline polyester resin is % by mass (in terms of solid content) based on the combined mass of the total binder resin and the release agent.

TABLE 1

| | Pigment | | | Pigment ratio (% by mass) | | | A + B (% by mass) | A:B (Mass ratio) | Total content of pigment (% by mass) | Crystalline polyester resin | | | Amorphous resin |
|---|---|---|---|---|---|---|---|---|---|---|---|---|---|
| | A | B | C | A | B | C | | | | No. | Acid value (mgKOH/g) | Content (% by mass) | Vinyl resin No./polyester resin No. |
| Example 1 | PR122 | PR49:3 | PR269 | 30 | 30 | 40 | 60 | 5:5 | 6.5 | 1 | 20 | 10 | 1/1 |
| Example 2 | PR122 | PR49:3 | PR269 | 45 | 45 | 10 | 90 | 5:5 | 6.5 | 1 | 20 | 10 | 1/1 |
| Example 3 | PR122 | PR49:3 | PR269 | 25 | 25 | 50 | 50 | 5:5 | 6.5 | 1 | 20 | 10 | 1/1 |
| Example 4 | PR122 | PR49:3 | PR269 | 72 | 18 | 10 | 90 | 8:2 | 6.5 | 1 | 20 | 10 | 1/1 |
| Example 5 | PR122 | PR49:3 | PR269 | 36 | 54 | 10 | 90 | 4:6 | 6.5 | 1 | 20 | 10 | 1/1 |
| Example 6 | PR122 | PR49:3 | PR269 | 40 | 10 | 50 | 50 | 8:2 | 6.5 | 1 | 20 | 10 | 1/1 |
| Example 7 | PR122 | PR49:3 | PR269 | 20 | 30 | 50 | 50 | 4:6 | 6.5 | 1 | 20 | 10 | 1/1 |
| Example 8 | PR202 | PR49:3 | PR269 | 30 | 30 | 40 | 60 | 5:5 | 6.5 | 1 | 20 | 10 | 1/1 |
| Example 9 | PR122 | PR48:3 | PR269 | 30 | 30 | 40 | 60 | 5:5 | 6.5 | 1 | 20 | 10 | 1/1 |
| Example 10 | PR122 | PR57:1 | PR269 | 30 | 30 | 40 | 60 | 5:5 | 6.5 | 1 | 20 | 10 | 1/1 |
| Example 11 | PR122 | PR49:3 | PR176 | 30 | 30 | 40 | 60 | 5:5 | 6.5 | 1 | 20 | 10 | 1/1 |
| Example 12 | PR122 | PR49:3 | PR269 | 30 | 30 | 40 | 60 | 5:5 | 6.5 | 1 | 20 | 10 | —/1 |
| Example 13 | PR122 | PR49:3 | PR269 | 30 | 30 | 40 | 60 | 5:5 | 6.5 | 2 | 15 | 10 | 1/1 |
| Example 14 | PR122 | PR49:3 | PR269 | 30 | 30 | 40 | 60 | 5:5 | 6.5 | 3 | 30 | 10 | 1/1 |
| Example 15 | PR122 | PR49:3 | PR269 | 30 | 30 | 40 | 60 | 5:5 | 6.5 | 4 | 20 | 10 | 1/1 |
| Example 16 | PR122 | PR49:3 | PR269 | 54 | 6 | 40 | 60 | 9:1 | 6.5 | 1 | 20 | 10 | 1/1 |
| Example 17 | PR122 | PR49:3 | PR269 | 18 | 42 | 40 | 60 | 3:7 | 6.5 | 1 | 20 | 10 | 1/1 |
| Example 18 | PR122 | PR49:3 | PR269 | 30 | 30 | 40 | 60 | 5:5 | 6.5 | 1 | 20 | 4 | 1/1 |
| Example 19 | PR122 | PR49:3 | PR269 | 30 | 30 | 40 | 60 | 5:5 | 6.5 | 1 | 20 | 33 | 1/1 |
| Comparative Example 1 | PR122 | PR49:3 | PR269 | 20 | 20 | 60 | 40 | 5:5 | 6.5 | 1 | 20 | 10 | 1/1 |
| Comparative Example 2 | PR122 | PR49:3 | PR269 | 47.5 | 47.5 | 5 | 95 | 5:5 | 6.5 | 1 | 20 | 10 | 1/1 |
| Comparative Example 3 | PR122 | PR49:3 | PR269 | 30 | 30 | 40 | 60 | 5:5 | 6.5 | — | — | — | 1/1 |
| Comparative Example 4 | PR122 | — | PR269 | 40 | — | 60 | 40 | 10:0 | 6.5 | 1 | 20 | 10 | 1/1 |
| Comparative Example 5 | — | PR49:3 | PR269 | — | 40 | 60 | 40 | 0:10 | 6.5 | 1 | 20 | 10 | 1/1 |
| Comparative Example 6 | PR122 | PR49:3 | — | 50 | 50 | — | 100 | 5:5 | 6.5 | 1 | 20 | 10 | 1/1 |

Pigment A: quinacridone-based pigment

Pigment B: metal element-containing monoazo pigment

PR49:3: C. I. Pigment Red 49:3 (containing Sr)

Pigment C: naphthol AS-based pigment

PR122: C. I. Pigment Red 122

PR48:3: C. I. Pigment Red 48:3 (containing Sr)

PR269: C. I. Pigment Red 269

PR202: C. I. Pigment Red 202

PR57:1: C. I. Pigment Red 57:1 (containing Ca)

PR176: C. I. Pigment Red 176

TABLE 2

| | | Low temperature fixability (° C.) | Toner scattering properties (mg) | Light fastness$\Delta E_{00}$ | GI value | Saturation |
|---|---|---|---|---|---|---|
| Example 1 | Toner 1 | 135 ○ | 8 ○ | 12 ○ | 0.186 ○ | 78 ○ |
| Example 2 | Toner 2 | 130 ○ | 7 ○ | 9 ○ | 0.181 ○ | 79 ○ |
| Example 3 | Toner 3 | 140 Δ | 11 Δ | 13 ○ | 0.213 Δ | 75 Δ |
| Example 4 | Toner 4 | 157 Δ | 9 ○ | 6 ○ | 0.218 Δ | 72 Δ |
| Example 5 | Toner 5 | 126 ○ | 17 Δ | 10 ○ | 0.184 ○ | 81 ○ |
| Example 6 | Toner 6 | 154 Δ | 9 ○ | 11 ○ | 0.202 Δ | 72 Δ |
| Example 7 | Toner 7 | 134 ○ | 10 Δ | 16 Δ | 0.189 ○ | 79 ○ |
| Example 8 | Toner 8 | 135 ○ | 8 ○ | 12 ○ | 0.185 ○ | 78 ○ |
| Example 9 | Toner 9 | 135 ○ | 9 ○ | 12 ○ | 0.184 ○ | 78 ○ |
| Example 10 | Toner 10 | 135 ○ | 6 ○ | 12 ○ | 0.185 ○ | 74 Δ |
| Example 11 | Toner 11 | 135 ○ | 8 ○ | 12 ○ | 0.186 ○ | 78 ○ |
| Example 12 | Toner 12 | 120 ○ | 7 ○ | 12 ○ | 0.191 Δ | 80 ○ |
| Example 13 | Toner 13 | 138 ○ | 10 Δ | 12 ○ | 0.184 ○ | 78 ○ |
| Example 14 | Toner 14 | 133 ○ | 7 ○ | 12 ○ | 0.187 ○ | 78 ○ |
| Example 15 | Toner 15 | 133 ○ | 5 ○ | 12 ○ | 0.184 ○ | 78 ○ |
| Example 16 | Toner 16 | 159 Δ | 6 ○ | 8 ○ | 0.214 Δ | 73 Δ |
| Example 17 | Toner 17 | 132 ○ | 19 Δ | 15 ○ | 0.182 ○ | 80 ○ |
| Example 18 | Toner 18 | 159 Δ | 6 ○ | 12 ○ | 0.184 ○ | 73 Δ |
| Example 19 | Toner 19 | 122 ○ | 10 Δ | 12 ○ | 0.188 ○ | 82 ○ |
| Comparative Example 1 | Toner 20 | 163 X | 22 X | 17 Δ | 0.229 X | 76 ○ |
| Comparative Example 2 | Toner 21 | 161 X | 24 X | 9 ○ | 0.179 ○ | 65 X |
| Comparative Example 3 | Toner 22 | 177 X | 15 Δ | 12 ○ | 0.187 ○ | 69 X |
| Comparative Example 4 | Toner 23 | 165 X | 10 Δ | 10 ○ | 0.251 X | 66 X |
| Comparative Example 5 | Toner 24 | 158 Δ | 20 X | 25 X | 0.239 X | 69 X |
| Comparative Example 6 | Toner 25 | 164 X | 26 X | 13 ○ | 0.177 ○ | 61 X |

From the results shown in Tables 1 and 2, it may be recognized that the toners manufactured in Examples 1-19 had a balanced combination of excellent low temperature fixability, scattering properties, a GI value, saturation, and light fastness, as compared with the toners of Comparative Examples 1-6.

Although embodiments of the present invention have been described and illustrated in detail, it is clearly understood that the same is by way of illustration and example only and not limitation, the scope of the present invention should be interpreted by terms of the appended claims.

What is claimed is:

1. A magenta toner for electrostatic charge image development comprising an amorphous resin and a crystalline polyester resin as a binder resin, wherein a quinacridone-based pigment represented by the following General Formula (1), a metal element-containing monoazo pigment represented by the following General Formula (2) or (2'), and a naphthol AS-based pigment represented by the following General Formula (3) are comprised as a coloring agent, and a combined content of the quinacridone-based pigment and the metal element-containing monoazo pigment is 50-90% by mass of the total coloring agent:

[Chemical Formula 1]

(1)

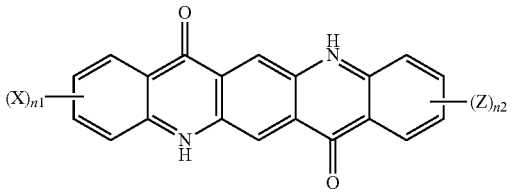

wherein X and Z are independently of each other a halogen atom, or an optionally substituted alkyl group or alkoxy group; and n1 and n2 are an integer of 0-4, respectively;

[Chemical Formula 2]

(2)

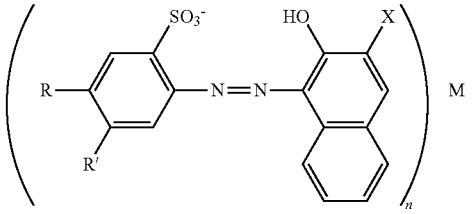

(2')

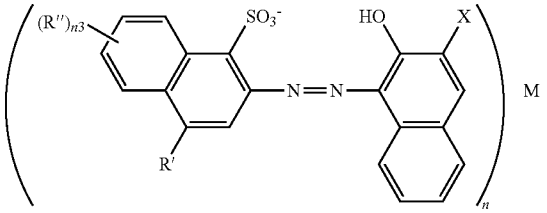

wherein R and R' denote a hydrogen atom, a halogen atom, or an optionally substituted alkyl group or alkoxy group; R" denotes a halogen atom, or an optionally substituted alkyl group or alkoxy group; n3 is an integer of 0-4; X is a hydrogen atom or a carboxylic acid anion; M is a monovalent or divalent metal ion; and n is a number determined by a valence number of X and M so that the metal element-containing monoazo pigment is electrically neutral;

[Chemical Formula 3]

(3)

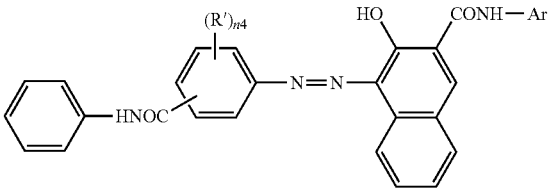

wherein R' is an optionally substituted alkyl group or alkoxy group; n4 is an integer of 0-4; and Ar is a hydrogen atom, an optionally substituted aryl group, or the following:

[Chemical Formula 4]

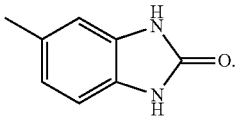

2. The magenta toner for electrostatic charge image development of claim 1, wherein a mass ratio of the quinacridone-based pigment and the metal element-containing monoazo pigment (quinacridone-based pigment: metal element-containing monoazo pigment) is 8:2 to 4:6.

3. The magenta toner for electrostatic charge image development of claim 1, wherein the metal element-containing monoazo pigment includes strontium, sodium or calcium as the metal element.

4. The magenta toner for electrostatic charge image development of claim 1, wherein the metal element-containing monoazo pigment includes a rosin compound.

5. The magenta toner for electrostatic charge image development of claim 1, further comprising a release agent, wherein a total content of the coloring agent is 5-10% by mass, based on total 100% by mass of the binder resin and the release agent.

6. The magenta toner for electrostatic charge image development of claim 1, wherein the binder resin has a domain matrix structure in which the amorphous resin containing at least a styrene acrylic resin is a matrix, and the crystalline polyester resin is a domain.

7. The magenta toner for electrostatic charge image development of claim 1, further comprising a release agent, wherein the crystalline polyester resin is comprised at 5-30% by mass, based on total 100% by mass of the binder resin and the release agent.

8. The magenta toner for electrostatic charge image development of claim 1, wherein the crystalline polyester resin is a hybrid crystalline polyester resin formed by chemically bonding a crystalline polyester polymerization segment and a vinyl polymerization segment.

9. The magenta toner for electrostatic charge image development of claim 1, wherein the crystalline polyester resin has an acid value (AV value) of 15-30 mgKOH/g.

10. The magenta toner for electrostatic charge image development of claim 1, wherein the amorphous resin contains an amorphous polyester resin.

* * * * *